US009522798B2

(12) United States Patent
Baum

(10) Patent No.: US 9,522,798 B2
(45) Date of Patent: Dec. 20, 2016

(54) CORRUGATED PAPERBOARD BOX CONVERTING MACHINE RETROFIT FOR ELIMINATING EDGE CRUSH TEST DEGRADATION

(71) Applicant: Theodore Michael Baum, Geneseo, IL (US)

(72) Inventor: Theodore Michael Baum, Geneseo, IL (US)

( * ) Notice: Subject to any disclaimer, the term of this patent is extended or adjusted under 35 U.S.C. 154(b) by 0 days.

(21) Appl. No.: 15/095,922

(22) Filed: Apr. 11, 2016

(65) Prior Publication Data

US 2016/0280484 A1 Sep. 29, 2016

Related U.S. Application Data

(60) Provisional application No. 62/179,191, filed on Apr. 30, 2015.

(51) Int. Cl.

| | |
|---|---|
| ***B65H 5/22*** | (2006.01) |
| ***B65H 5/06*** | (2006.01) |
| ***B65H 7/20*** | (2006.01) |
| ***B65H 3/06*** | (2006.01) |

(52) U.S. Cl.

CPC ..... *B65H 5/066* (2013.01); *B65H 3/063* (2013.01); *B65H 3/0669* (2013.01); *B65H 3/0676* (2013.01); *B65H 3/0692* (2013.01); *B65H 2403/42* (2013.01); *B65H 2404/1542* (2013.01); *B65H 2404/54* (2013.01); *B65H 2404/623* (2013.01); *B65H 2406/3122* (2013.01); *B65H 2601/61* (2013.01); *B65H 2701/1762* (2013.01); *Y10T 29/49716* (2015.01)

(58) Field of Classification Search

CPC ..... B65H 5/066; B65H 3/063; B65H 3/0669; B65H 3/0676; B65H 3/0692; B65H 2701/1762; B65H 2403/42; B65H 2404/1542; B65H 2404/54; B65H 2404/623; B65H 2406/3122; B65H 2601/61; Y10T 29/49716

See application file for complete search history.

(56) References Cited

U.S. PATENT DOCUMENTS

| | | | |
|---|---|---|---|
| 3,941,372 | A | 3/1976 | Matsuo |
| 4,045,015 | A | 8/1977 | Sardella |
| 4,236,708 | A | 12/1980 | Matsuo |
| 4,494,745 | A | 1/1985 | Ward et al. |
| 4,614,335 | A | 9/1986 | Sardella |
| 4,828,244 | A | 5/1989 | Sardella |
| 4,867,433 | A | 9/1989 | Wells |
| 4,896,872 | A | 1/1990 | Sardella |

(Continued)

*Primary Examiner* — John C Hong

(57) ABSTRACT

A box machine is retrofitted by removing the upper feed roll, sheet feeder, and by replacing the lower feed roll with a drive shaft. A transport section and a sheet feeder are then inserted into the box machine. The transport section comprises transport wheels driven by the drive shaft which engage a sheet to transport it to the box machine without crushing. The sheet feeder comprises feed wheels driven by a servo motor for feeding the lowermost sheet of a stack to the transport section. A feed interrupter is movable from a raised stop-feed position to a lowered feed position by cams rotated by a servo motor. A controller coordinates the velocity of the feed wheels and position of the feed interrupter. Retrofitted machines eliminate the need to increase Edge Crush Test ratings of sheets from the corrugator 15% to 20% greater than printed in the certificate stamp.

3 Claims, 20 Drawing Sheets

(56) References Cited

U.S. PATENT DOCUMENTS

| | | | |
|---|---|---|---|
| 5,006,042 | A | 4/1991 | Park |
| 5,048,812 | A | 9/1991 | Holmes |
| 5,074,539 | A | 12/1991 | Wells |
| 5,184,811 | A | 2/1993 | Sardella et al. |
| 5,228,674 | A | 7/1993 | Holmes |
| 6,179,763 | B1 | 1/2001 | Phillips, III |
| 6,543,760 | B1 | 4/2003 | Andren |
| 6,824,130 | B1 | 11/2004 | Sardella et al. |
| 7,621,524 | B2 | 11/2009 | Levin |
| 8,100,397 | B2 | 1/2012 | Sardella |

Regular Feed
One Sheet Per Feed Cycle

Dual Feed
Two Sheets Per Feed Cycle

Skip Feed
One Sheet Per Two Machine Cycles

CORRUGATED PAPERBOARD BOX CONVERTING MACHINE RETROFIT FOR ELIMINATING EDGE CRUSH TEST DEGRADATION

CROSS-REFERENCE TO RELATED APPLICATIONS

This application claims the benefit of Provisional Patent Application No. 62/179,191 filed Apr. 30, 2015 by the present inventor and entitled Corrugated Box Converting Machine Retrofit for Eliminating Edge Crush Test Degradation which is incorporated by reference. The filing date priority of my aforementioned provisional application is hereby claimed for the subject application.

STATEMENT REGARDING FEDERALLY SPONSORED RESEARCH OR DEVELOPMENT

Not Applicable.

REFERENCE TO SEQUENCE LISTING, A TABLE, OR A COMPUTER PROGRAM LISTING COMPACT DISC APPENDIX

Not Applicable.

BACKGROUND OF THE INVENTION

Prior Art

The following is a tabulation of some prior art that presently seems relevant:

| U.S. Patents | | | |
|---|---|---|---|
| Patent Number | Kind Code | Issue Date | Patentee |
| 7,621,524 | B2 | Nov. 24, 2009 | Levin |
| 6,824,130 | B1 | Nov. 30, 2004 | Sardella and West |
| 6,543,760 | B1 | Apr. 8, 2003 | Andren |
| 5,006,042 | | Apr. 9, 1991 | Park |
| 5,451,042 | | Sep. 19, 1995 | Cuir |
| 5,184,811 | | Feb. 9, 1993 | Sardella and West |
| 4,896,872 | | Jan. 30, 1990 | Sardella |
| 4,828,244 | | May 9, 1989 | Sardella |
| 5,228,674 | | Jul. 20, 1993 | Holmes |
| 5,048,812 | | Sep. 17, 1991 | Holmes |
| 3,941,372 | | Mar. 2, 1976 | Matsuo |
| 4,236,708 | | Dec. 2, 1980 | Matsuo |
| 4,494,745 | | Jan. 22, 1985 | Ward, West |
| 4,867,433 | | Sep. 19, 1989 | Wells |
| 5,074,539 | | Dec. 24, 1991 | Wells |
| 4,045,015 | | Aug. 30, 1997 | Sardella |
| 4,614,335 | | Sep. 30, 1986 | Sardella |
| 6,179,763 | B1 | Jan. 30, 2001 | Philips 111 |
| 8,100,397 | B2 | Jan. 24, 2012 | Sardella |

This invention relates to the manufacture of corrugated paperboard boxes in compliance with the National Motor Freight Classification Item 222 and the National Railroad Freight Committee's Uniform Freight Classification Rule 41 standards for box manufacture.

This invention particularly relates to the manufacturing of corrugated paperboard boxes with Edge Crush Test certification under these standards Corrugated paperboard boxes are used to safely ship products throughout the United States and the world. Items ranging from lightweight and small, to heavy and large are safely transported in corrugated paperboard boxes.

The ability to safely transport this large range of items in paperboard boxes is assured because corrugated paperboard boxes are manufactured to comply with the National Motor Freight Classification Item 222 and the National Railroad Freight Committee's Uniform Freight Classification Rule 41 standards for box manufacture.

To comply with the standards, corrugated paperboard boxes are required to be tested by either an Edge Crush Test, or a Burst Test to certify their durability and strength. A small square is cut from a finished box and the appropriate test is performed. The resulting Edge Crush Test rating in lbs./inch, or the Burst Test rating in lbs. is printed in a box-makers certificate on each box, certifying the strength of the finished boxes, as required by Rule 41 of the Uniform Freight Classification of the railroads and the nearly identical Item 222 of the National Motor Freight Classification.

Historically, for nearly a century, the only standard test was the Burst (Mullen) Test, which is indirectly related to a carton's ability to withstand external or internal forces to contain and protect a product during shipment, and is related to the rough handling of individual boxes. The Burst Test mandates a "minimum combined weight of facings", thereby offering no opportunity to save corrugated paperboard material. Burst Test ratings are not degraded when the combined board is crushed.

In 1991 an alternative Edge Crush Test was approved that is now the dominant test used in the industry. Edge Crush Test is a true performance test directly related to the stacking strength of a box. By providing an alternative to the Burst test mandate for a minimum combined weight of facings, Edge Crush Testing allows the use of lighter weight, less costly board without sacrificing stacking strength. Edge Crush Test ratings, however, are degraded when the combined board is crushed.

Since 1991, corrugated paperboard box manufacturers have manufactured boxes with either a Burst test certification, or an Edge Crush Test certification, depending on the specific shipping requirements.

In a box making plant corrugated paperboard is produced on a corrugator. The board continues through the corrugator and is cut into predetermined sheet sizes, stacked, and delivered in stacks to converting machinery to be converted into boxes.

Existing converting machinery crushes the corrugated paperboard during converting machine operations. The Burst Test ratings of Burst Test certified boxes are not degraded when corrugated paperboard is crushed by existing converting machinery. Edge Crush Test ratings, however, are degraded when the corrugated paperboard is crushed by existing converting machinery.

Because the Burst ratings are not degraded when corrugated paperboard is crushed by converting machinery, and Edge Crush Test ratings are degraded when corrugated paperboard is crushed by converting machinery, two different manufacturing methods are used for Burst Test and Edge Crush Test certified boxes produced on existing converting machinery.

In the manufacturing of Burst certified boxes, sheets from the corrugator are supplied to converting machinery with a Burst rating that is the same as the Burst rating printed on the certificate stamp, because Burst ratings are not degraded when corrugated paperboard is crushed by converting machinery In the manufacturing of Edge Crush Test certified boxes, however, it is industry wide recommended practice to supply sheets from the corrugator to converting machinery with an Edge Crush Test rating that is from 15% to 20% percent greater than the Edge Crush Test value printed on the certificate stamp, in order to compensate for Edge Crush Test converting machinery degradation, because Edge Crush Test ratings are degraded when corrugated paperboard is crushed by converting machinery.

Increasing the Edge Crush Test rating of sheets from the corrugator from 15% to 20% percent, currently necessary to compensate for Edge Crush Test converting degradation on existing converting machinery, increases fiber use and increases the cost of Edge Crush Test certified boxes. Eliminating Edge Crush Test converting machinery degradation would eliminate the need to increase the Edge Crush Test rating of sheets from the corrugator from 15% to 20% percent, and would benefit the customer, the converter, the corrugated box industry, and the environment.

In a box making plant the sheets produced on the corrugator are delivered in stacks to the converting machinery to be converted into boxes.

In the corrugated paperboard industry it is known to use lead edge sheet feeders at the beginning of converting machinery to feed single sheets from a stack to converting operations. Modern sheet feeders of conventional design, for example, as disclosed in U.S. Pat. No. 5,184,811 to Sardella, U.S. Pat. No. 6,824,130 to Sardella, U.S. Pat. No. 4,896,872 to Sardella, and U.S. Pat. No. 4,828,244 to Sardella use vacuum assisted feeding elements, such as feed wheels, to transfer the sheet from beneath the stack of sheets to a feed roll nip between a pair of feed rolls for taking over feeding of each sheet from the feed wheels and then feeding the sheet to downstream operations. The feed roll nip is an essential component of these sheet feeders.

The feed rolls are arranged one on top of the other and are spaced slightly apart from each other. The feed rolls must be spaced apart a distance which is smaller than the thickness of the sheet being fed, to press against the sheet and generate enough frictional grip to pull the sheet from beneath the stack and transfer the sheet to downstream converting operations. The small opening between the upper and lower feed rolls through which the sheet must pass is commonly known as the "feed roll nip".

It is an essential part of conventional sheet feeder operation to make the opening at the feed roll nip small enough to ensure that the sheet is under control for transferring to subsequent machine operations. It is common with conventional feeders to make the feed roll nip between the upper and lower feed rolls so small that the corrugated layer of the sheet is crushed by the feed rolls as it is gripped by them, resulting in Edge Crush Test degradation.

The feed roll nip is recognized in the industry as the major cause of undesirable Edge Crush Test converting degradation.

Retrofitting existing converting machines to eliminate the feed roll nip would eliminate the major source of Edge Crush Test converting degradation, and eliminate the need to supply converting machines with sheets from the corrugator with an Edge Crush Test rating that is from 15% to 20% percent greater than the Edge Crush Test value printed on the certificate stamp, in order to compensate for Edge Crush Test converting degradation. Retrofitting existing converting machines to eliminate the feed roll nip would be a practical and cost effective way to eliminate this wasteful practice.

Eliminating the feed roll nip presents a problem, however, in that the feed roll nip is the nip between the upper and lower feed roll on all existing conventional converting machines, and the lower feed roll is used to drive the main gear train on all existing conventional converting machines. Eliminating the lower feed roll would eliminate the drive for the main gear train of the converting machine.

Eliminating the feed roll nip presents an additional problem, in that the feed roll nip is an essential component of conventional sheet feeders. The feed roll nip is necessary to pull the trailing portion of the sheet from the sheet feeder.

It has been proposed to use lead edge sheet feeders with no feed rolls, as disclosed in U.S. Pat. No. 3,941,372 to Matsuo, U.S. Pat. No. 4,236,708 to Matsuo, U.S. Pat. No. 5,006,042 to Park, U.S. Pat. No. 5,451,042 to Cuir, U.S. Pat. No. 6,543,760 to Andrien, U.S. Pat. No. 7,621,524 to Levin, U.S. Pat. No. 5,228,674 to Holmes and U.S. Pat. No. 5,048,812 to Holmes to solve the problem of crushing the corrugated paperboard sheets by the feed roll nip. These disclosures, however, fail to address how these lead edge sheet feeders with no feed rolls can be retrofitted into existing converting machines. Converting machines with feed rolls have been manufactured from the early nineteen hundreds until the present time. Replacing the vast number of existing converting machines that have feed rolls with new converting machines that have no feed rolls, to solve the problem of crushing the corrugated paperboard sheets by the feed roll nip, is not a practical solution to the problem, because of the enormous capital cost of new converting machines that would be involved.

Emba Machinery AB, Orebro, Sweden, a manufacturer of converting machinery, offers new converting machines with no feed rolls (model 245 QS Ultima), that include a sheet feeder with no feed roll nip, as disclosed in U.S. Pat. No. 7,621,524 to Levin. Emba Machinery has reported that, with this converting machine, there is no longer any need to increase the ECT value of sheets from the corrugator by 15% percent in order to compensate for ECT converting degradation, because the feed roll nip has been eliminated. Emba Machinery does not offer a machine retrofit, however, for the vast number of existing converting machines operating with a feed roll nip. U.S. Pat. No. 7,621,524 to Levin fails to disclose how such lead edge sheet feeders, with no feed rolls, can be retrofitted into existing box converting machines.

Accordingly, there is a need for a practical and cost effective method for retrofitting the vast number of existing box converting machines to eliminate the feed roll nip and thereby end the wasteful practice of increasing the incoming Edge Crush Test rating of sheets from the corrugator by 15% to 20% percent in order to compensate for Edge Crush Test converting degradation, and a non-crush sheet feeder comprising a non-crush constant speed transport section and a variable speed sheet feeder section for use with such retrofitted corrugated paperboard converting machines.

BRIEF SUMMARY OF THE INVENTION

A primary object of the present invention is to provide a simple, practical, and cost effective method and apparatus for retrofitting existing box converting machines to eliminate a feed roll nip and thereby end the wasteful practice of increasing the incoming Edge Crush Test rating of sheets from the corrugator by 15% to 20% percent in order to compensate for Edge Crush Test converting degradation.

Another object of the present invention is to provide a non-crush sheet feeder comprising a non-crush constant speed transport section and a variable speed sheet feeder section for use with such retrofitted corrugated paperboard converting machines.

Described herein is a device and method for retrofitting existing corrugated paperboard converting machines for ending the industry wide wasteful practice of manufacturing corrugated paperboard sheets on the corrugator with Edge Crush Test ratings that are from 15% to 20% percent greater than the Edge Crush Test rating printed in the box-maker's certificate, in order to compensate for the degradation of the Edge Crush Test rating of the box, caused by existing converting machinery.

The device and method disclosed herein eliminates the converting machine feed roll nip that is the cause of increasing the incoming Edge Crush Test rating of sheets from the corrugator by 15% to 20% percent to compensate for Edge Crush Test converting degradation.

The advantages described above are achievable whereby a conventional corrugated paperboard box converting machine comprising feed rolls, a feed roll nip, and a conventional sheet feeder is retrofitted by first removing the conventional sheet feeder, and by removing the feed rolls.

A machine drive shaft, a non-crush sheet feeder comprising a variable speed sheet feeder section, and a non-crush constant speed vacuum transport section, is then inserted into the box converting machine.

The variable speed sheet feeder section may comprise a plurality of variable speed feed wheels which engage the lowermost sheet of a stack of sheets to feed it to the constant speed vacuum transport section. The variable speed feed wheels protrude above the top of a vacuum chamber for holding the sheet against the feed wheels.

The non-crush constant speed vacuum transport section may comprise a plurality of constant speed vacuum transport wheels which engage the sheet to transport it to the box converting machine without crushing. The constant speed transport wheels protrude above the top of a vacuum chamber for holding the sheet against the transport wheels.

Corrugated paperboard box converting machines so retrofitted eliminate the existing feed roll nip for ending the wasteful practice of increasing the incoming Edge Crush Test value of sheets from the corrugator by 15% to 20% percent in order to compensate for Edge Crush Test converting degradation caused by the eliminated feed roll nip.

BRIEF DESCRIPTION OF THE SEVERAL VIEWS OF THE DRAWINGS

In the accompanying drawings, in which like reference characters in the same or different Figures indicate like parts.

DETAILED DESCRIPTION

Prior Art

Figure 1A:
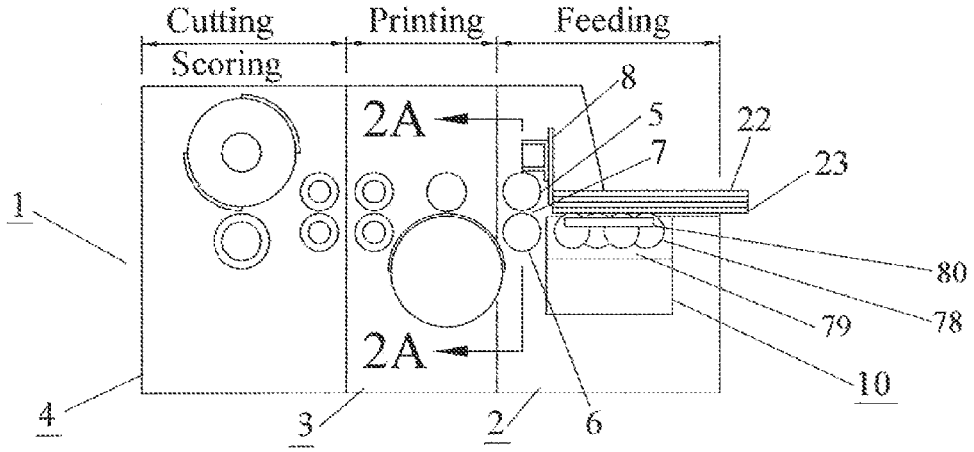
FIG. 1A (Prior Art)
FIG. 1A is a simplified diagrammatic side elevational view of a box converting machine according to prior art.
Figure 2A:
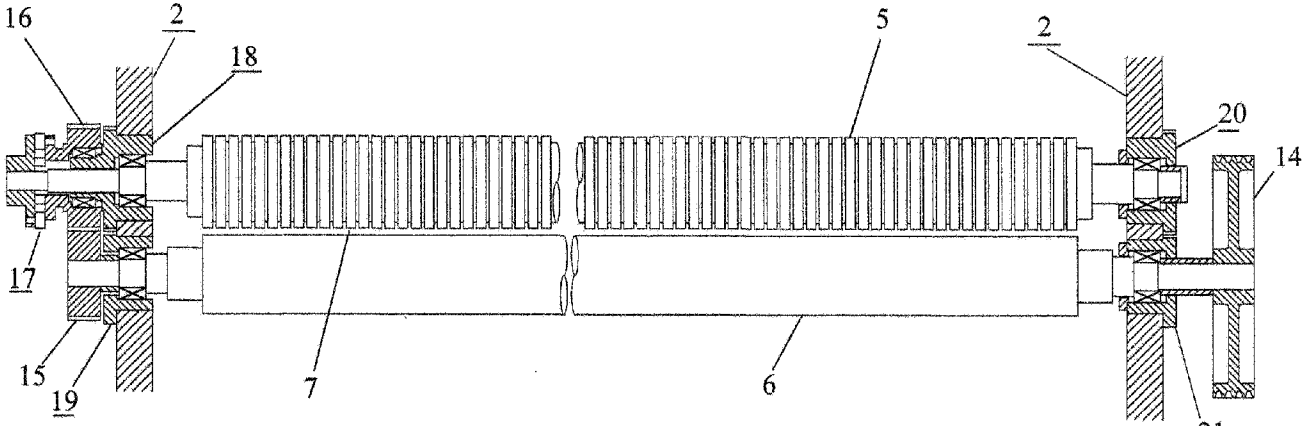
FIG. 2A is a cross-sectional view taken generally along lines 2A-2A of FIG. 1A showing a section through feed rolls of a box converting machine according to prior art.

Referring to the drawings in detail, there is illustrated in schematics FIG. 1A and FIG. 2A, a box converting machine 1 of the prior art, comprising a Feeding section 2, a Printing section 3, and a Cutting-Scoring section 4. Feeding section 2 comprises an upper feed roll 5, a lower feed roll 6, a feed roll nip 7, a feed gate 8, and a conventional variable speed sheet feeder 10 adapted to feed sheet 23 to a feed roll nip 7. Conventional sheet feeder 10 may be as described in U.S. Pat. No. 5,184,811 to Sardella, U.S. Pat. No. 6,824,130 to Sardella, U.S. Pat. No. 4,896,872 to Sardella, and U.S. Pat. No. 4,828,244 to Sardella. Conventional sheet feeder 10 comprises a plurality of variable speed feed wheels 78 protruding above a vacuum chamber 38 with an intense vacuum for feeding sheet 23, the lowermost sheet of stack 22, past feed gate 8 and to feed roll nip 7 between upper feed roll 5 and lower feed roll 6.

Referring to FIG. 2A, a section through the upper feed roll 5 and lower feed roll 6 of a converting machine 1 of the prior art is shown. Concentric bearing housings 19 and 21 are supported by side frames of feed section 2. Lower feed roll 6 is supported for rotation in concentric bearing housings 19 and 21. Eccentric bearing housings 18 and 20 are supported for rotation in side frames of feed section 2. Upper feed roll 5 is supported for rotation in eccentric bearing housings 18 and 20. Machine drive pulley 14 is fixed to lower feed roll 6 to be rotated by a machine drive motor, not shown. Machine drive gear 15 is fixed to lower feed roll 6. Machine drive gear 15 is the drive gear for the main gear train of box machine 1 through a gear mesh not shown. Drive gear 15 also meshes with gear 16 for driving upper feed roll 5 through permanent mesh assembly 17. The opening at nip 7 is adjustable to grip sheet 23 by rotation of eccentric bearing housings 18 and 20 by a control shaft not shown. A proper mesh between gears 15 and 16 is maintained during adjustment by permanent mesh assembly 17. Permanent mesh assembly 17 is a modified Oldham coupling, well known by those in the industry.

Operation:

Referring now to FIG. 1A and FIG. 2A. In the operation of one prior art converting machine 1 feed cycle, a machine drive motor, not shown, rotates machine drive pulley 14, lower feed roll 6 and machine drive gear 15, to drive the main gear train of converting machine 1 through a gear mesh with gear 15, not shown. Machine drive gear 15 additionally meshes with gear 16 to rotate upper feed roll 5 through permanent mesh assembly 17.

Referring to FIG. 1A, sheet 23 and sheet stack 22 are supported by a variable speed sheet feeder 10 comprising driven variable speed feed wheels 78. At the beginning of a machine 1 operating cycle, variable speed feed wheels 78 engage lowermost sheet 23 of stack 22 and drive sheet 23 to nip 7 between upper feed roll 5 and lower feed roll 6 of box converting machine 1. Below sheet 23 is a feed interrupter 80 moveable between a raised stop-feed position wherein variable speed feed wheels 78 are spaced from sheet 23 and a lowered feed position wherein sheet 23 engages variable speed feed wheels 78 and is thereby driven by variable speed feed wheels 78. Below feed interrupter 80 is a vacuum chamber 79 for generating an intense vacuum on the underside of sheet 23 for holding sheet 23 against rotating variable speed feed wheels 78 when feed interrupter 80 is in its lowered position. Variable speed feed wheels 78 and the movement of feed interrupter 80 are indirectly driven by the main gear train, not sown, of converting machine 1.

In the operation of one converting machine 1 operating cycle, with feed interrupt feed interrupter 80 in its lowered feed position, variable speed feed wheels 78 contact sheet 23 and drive sheet 23 to nip 7 between feed rolls 5 and 6, at which point feed roll nip 7 grips sheet 23 to drive sheet 23 and continues to drive sheet 23 at a constant speed until the trailing edge of sheet 23 passes feed roll nip 7.

Prior to the trailing edge of sheet 23 contacting the most upstream feed wheel 78, feed interrupter 80 rises to its raised position to prevent contact between variable speed feed wheels 78 and the next sheet in stack 22.

When feed interrupter 80 is in a raised position, the intense vacuum of vacuum chamber 38 holds the trailing portion of sheet 23 against feed interrupter 80.

In order for nip 7 to grip sheet 23 with sufficient frictional traction to pull the trailing edge of sheet 23 from feed interrupter 80 against the intense vacuum force of vacuum chamber 79, the opening at nip 7 must be made smaller than the thickness of sheet 23. The corrugated medium of sheet 23 is thereby crushed as it passes through nip 7. Crushing the corrugated medium of the sheet 23 results in Edge Crush Test degradation.

The general construction and operation of the feed wheels 78, the raising and lowering of feed interrupter 80, the drive apparatus for feed wheels 78, the application of vacuum, and the timing of these movements is described and illustrated in greater detail in U.S. Pat. No. 5,184,811 to Sardella, U.S. Pat. No. 6,824,130 to Sardella, U.S. Pat. No. 4,896,872 to Sardella, and U.S. Pat. No. 4,828,244 to Sardella, which are incorporated by reference.

DETAILED DESCRIPTION OF THE PRESENT INVENTION

Detailed Description of Converting Machine Retrofit

Referring now to FIG. 1B, FIG. 2B, FIG. 1C, FIG. 2C, FIG. 2D, and FIG. 2E, in accordance with one aspect of the present invention, there is illustrated a method for retrofitting conventional converting machine 1 to eliminate feed roll nip 7 and its associated Edge Crush Test degradation.

Figure 1B:
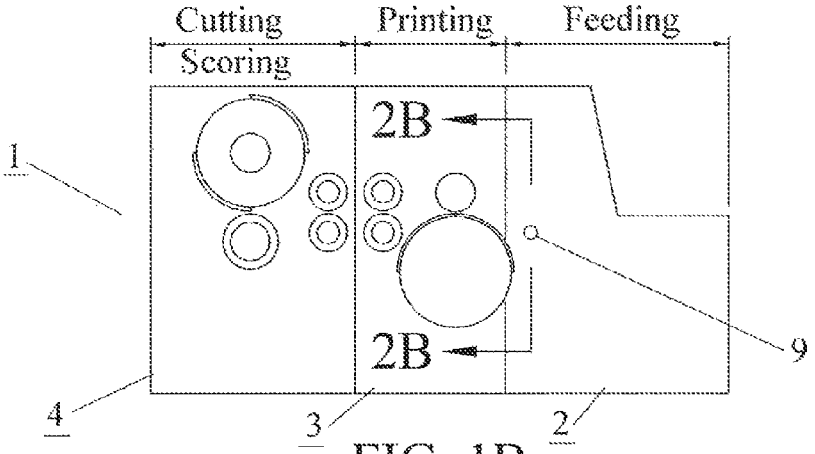
FIG. 1B is a simplified diagrammatic side elevational view of the machine of FIG. 1A with parts removed in accordance with a retrofitting method described herein.
Figure 2B:
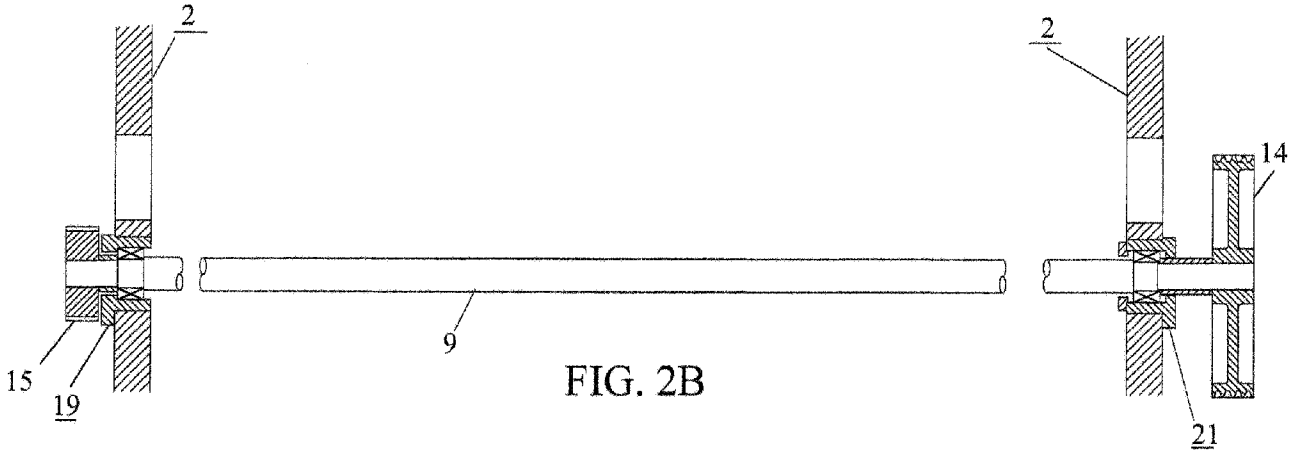
FIG. 2B is a cross-sectional view taken generally along lines 2B-2B of FIG. 1B; showing a section through a drive shaft in accordance with a retrofitting method described herein.

Referring now to FIG. 1B and FIG. 2B, in which conventional converting machine 1 is shown after the initial retrofitting steps of: removing feed gate 8, removing upper feed roll 5, removing bearing housings 18, and 20, removing lower feed roll 6, and inserting drive shaft 9.

Referring now to FIG. 2B, a section through drive shaft 9 is shown. Concentric bearing housings 19 and 21 are supported by side frames of feed section 2. Drive shaft 9 is supported for rotation in concentric bearing housings 19 and 21. Machine drive pulley 14 is fixed to drive shaft 9 for rotation by a machine drive motor, not shown. Machine drive gear 15 is fixed to drive shaft 9. Machine drive gear 15 is the drive gear for the gear train of box machine 1 through a gear mesh not shown.

Referring now to FIG. 1C and FIG. 2C, FIG. 3C, and FIG. 4C in which conventional converting machine 1 is shown after the retrofitting steps of: inserting a variable speed feed section 13 adapted to operate with a vacuum transport section, and constant speed vacuum transport section 12, and by inserting feed gate 8 into feed section 2 of box converting machine 1.

Figure 2C:
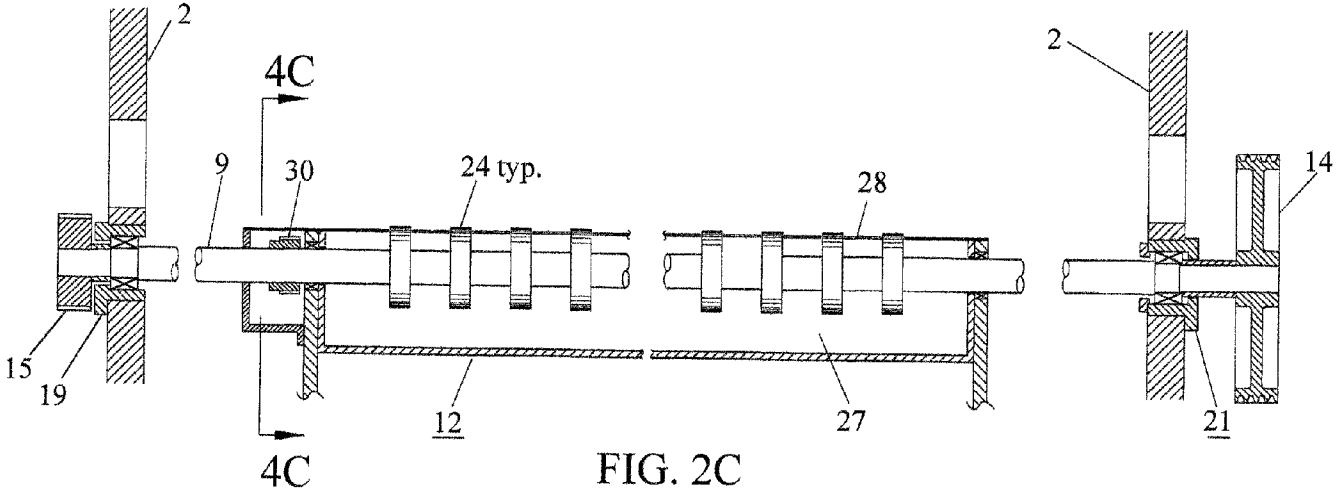
FIG. 2C is a cross-sectional view taken generally along lines 2C-2C of FIG. 1C showing a section through a constant speed drive shaft after a retrofitting method described herein.

Referring now to FIG. 2C, a section through drive shaft 9 of retrofitted converting machine 1 is shown. Concentric bearing housings 19 and 21 are supported by side frames of feed section 2. Drive shaft 9 is supported for rotation in concentric bearing housings 19 and 21. Machine drive pulley 14 is fixed to drive shaft 9 to be rotated by a machine drive motor, not shown. Machine drive gear 15 is fixed to drive shaft 9. Machine drive gear 15 is the drive gear for the gear train of box machine 1 through a gear mesh not shown.

Drive shaft 9 passes through constant speed transport section 12 and gear case 33. Constant speed transport section 12 is supported by feeder section 2 side frames through support plates 31 and 32. Constant speed transport section drive gear 30 is fixed to drive shaft 9. Transport wheels 24 are fixed to drive shaft 9 and protrude above vacuum chamber 27. An intense vacuum pressure is generated in vacuum chamber 27 by a vacuum blower, not shown, for communicating intense vacuum pressure to the underside of sheet 23, through openings in vacuum chamber cover 28, for generating an intense vacuum on the underside of sheet 23 for holding sheet 23 against constant speed transfer wheels 24 and 25.

Figure 1C:
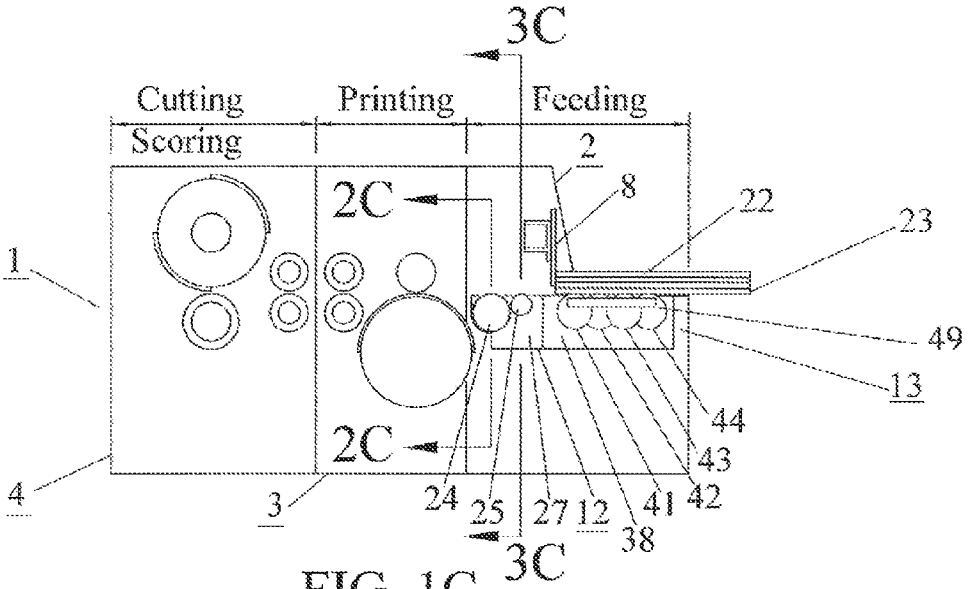
FIG. 1C is a simplified diagrammatic side elevational view of the machine of FIG. 1A after it has been retrofitted in accordance with a retrofitting method described herein.
Figure 3C:
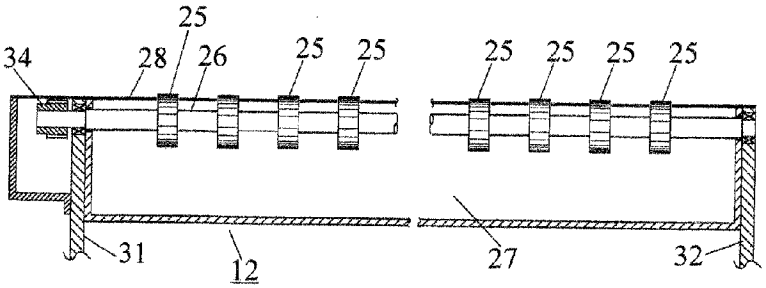
FIG. 3C is a cross-sectional view taken generally along lines 3C-3C of FIG. 1C showing a section through a constant speed driven shaft after a retrofitting method described herein.

Referring to FIG. 1C, and FIG. 3C, a section through transport wheels 24 is shown. Transport wheel shaft 26 is supported for rotation in support plates 31 and 32. Driven gear 34 is fixed to shaft 26 for driving shaft 26.

Figure 4C:
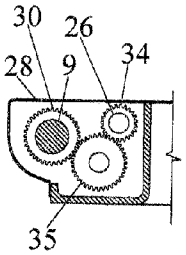
FIG. 4C is a cross-sectional view taken generally along lines 4C-4C of FIG. 2C showing a constant speed drive train for driving a constant speed driven shaft after a retrofitting method described herein.

Referring to FIG. 4C, a drive train for driving transport wheels 25 is shown. Transport section drive gear 30 is fixed to drive shaft 9 for rotating transport wheels 25 through idler gear 35, and driving shaft 26.

Operation:

Referring now to FIG. 1C, FIG. 2C, FIG. 3C, and FIG. 4C. In the operation of one converting machine 1 feed cycle, a machine drive motor, not shown, rotates machine drive pulley 14, drive shaft 9, and machine drive gear 15, to drive the main gear train of converting machine 1 through a gear mesh with gear 15, not shown.

Referring to FIG. 1C, sheet 23 and sheet stack 22 are supported by a variable speed sheet feeder section 13 adapted to operate with a constant speed transport section comprising driven variable speed feed wheels 41, 42, 43, 44. At the beginning of a machine 1 operating cycle, variable speed feed wheels 41, 42, 43, 44 engage lowermost sheet 23 of stack 22 and drive sheet 23 to cover constant speed transfer section 12. Below sheet 23 is a feed interrupter 49 moveable between a raised no-feed position wherein variable speed feed wheels 41, 42, 43, 44 are spaced from sheet 23 and a lowered feed position wherein sheet 23 engages variable speed feed wheels 41, 42, 43, 44 and is thereby driven by variable speed feed wheels 41, 42, 43, 44. Below feed interrupter 49 is a vacuum chamber 38 for generating an intense vacuum on the underside of sheet 23 for holding sheet 23 against rotating variable speed feed wheels 41, 42, 43, 44 when feed interrupter 49 is in its lowered position.

In the operation of one converting machine 1 operating cycle, with feed interrupter 49 in its lowered position, variable speed feed wheels 41, 42, 43, 44 feed sheet 23 past feed gate 8 and to cover constant speed vacuum transport section 12, at which point constant speed transport wheels 24, 25 acquire maximum vacuum traction and drive sheet 23 and continue to drive sheet 23 at constant speed until the trailing edge of sheet 23 pass constant speed transport wheels 25.

Feed wheels 41, 42, 43, 44 stop feeding sheet 23 when the trailing edge of sheet 23 reaches the most upstream feed wheel 44, to prevent feed wheel 41, 42, 43, 44 from contacting the next sheet of stack 22. At this point in the feed cycle, transport of sheet 23 is continued by constant speed vacuum transport wheels 24 and 25.

The intense vacuum on the underside of sheet 23 for holding sheet 23 against constant speed vacuum transfer wheels 24 and 25 provides sufficient frictional traction to pull the trailing portion of sheet 23 from feed interrupter 49 against the intense vacuum force of vacuum chamber 38.

The corrugated medium of sheet 23 is not crushed as it is transported downstream by vacuum transport wheels 24 and 25. Because sheet 23 is not crushed, there is no Edge Crush Test degradation.

Prior art variable speed sheet feeders that were originally designed to feed sheets to a feed roll nip such as U.S. Pat. No. 5,184,811 to Sardella, U.S. Pat. No. 6,824,130 to Sardella, U.S. Pat. No. 4,896,872 to Sardella, and U.S. Pat. No. 4,828,244 to Sardella, with the general construction and operation of feed wheels, raising and lowering of a feed interrupter, a variable speed drive apparatus for driving feed wheels, the application of vacuum, and the timing of these movements could presumably be modified to instead operate with a constant speed vacuum transport section described above. One embodiment of an improved variable speed sheet feeder section 13 that is particularly more suited for retrofitting a conventional converting machine is described below.

Figure 3:
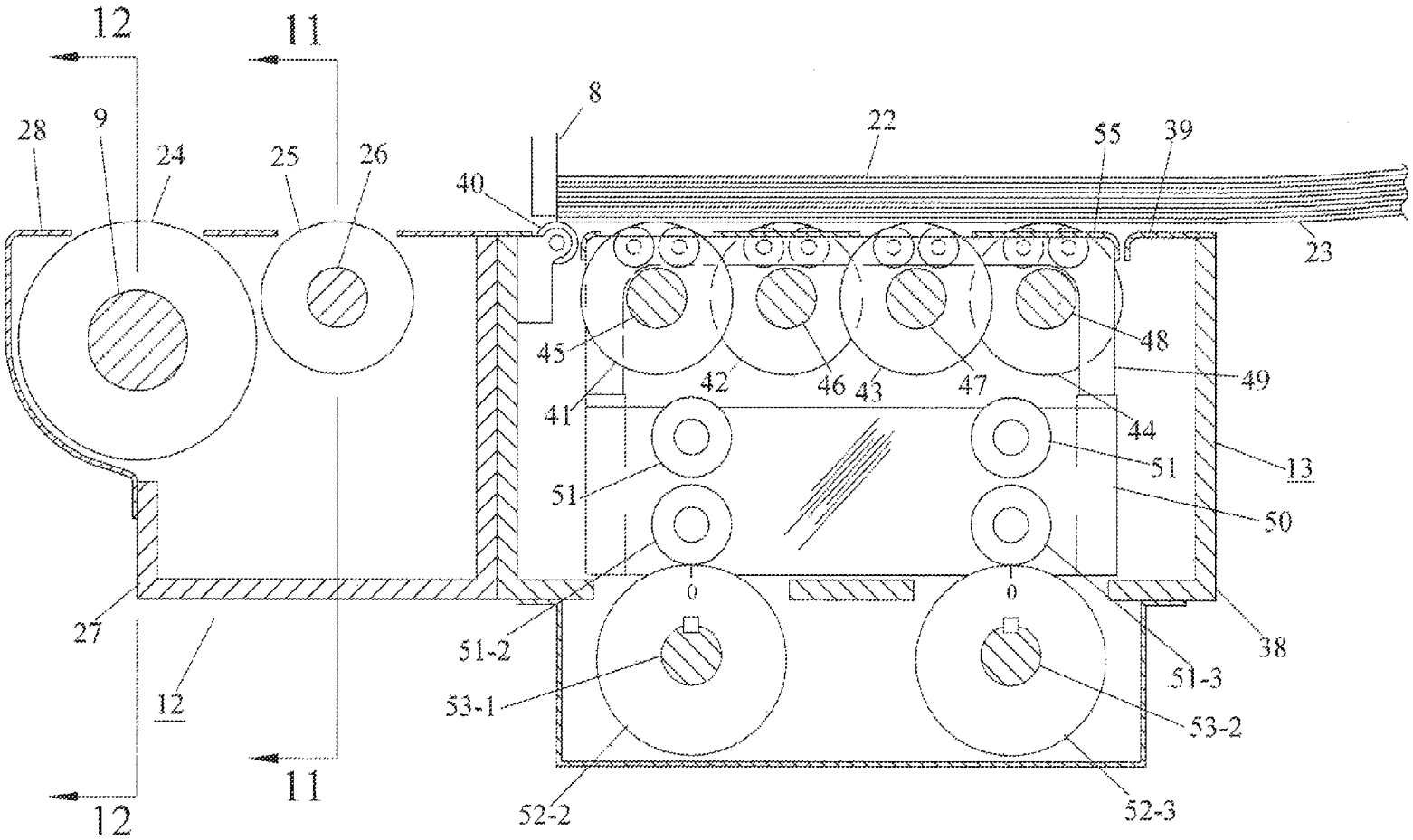
FIG. 3 is a side elevation sectional view comprising a variable speed feed section and a constant speed non-crush transport section described herein.
Figure 4:
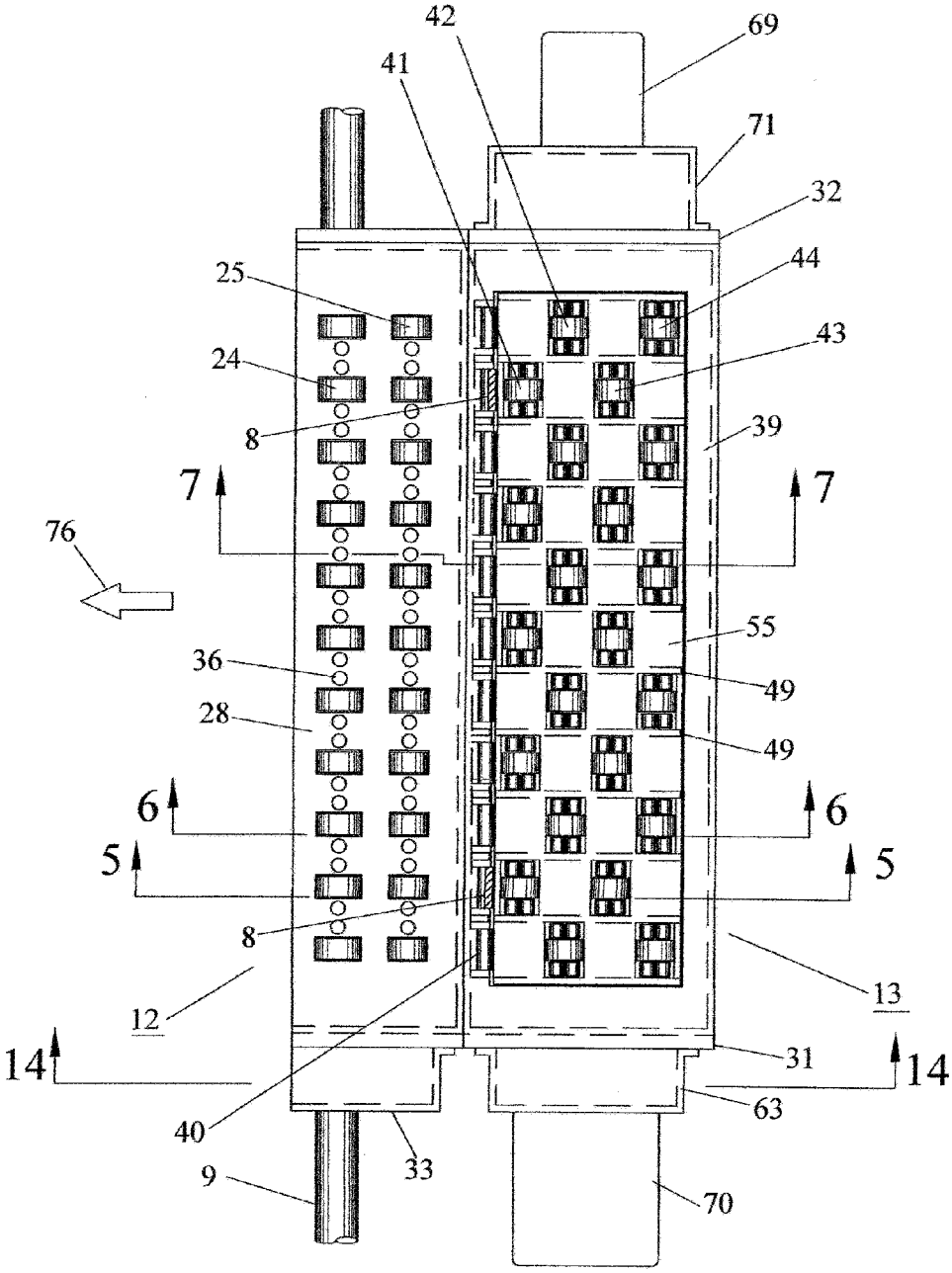
FIG. 4 is a plan view of the variable speed feed section and constant speed non-crush transport section of FIG. 3 described herein.

Detailed Description of One Embodiment of a Sheet Feeder for Retrofitting a Conventional Converting Machine:

Referring now to FIG. 3, and FIG. 4, there is shown one embodiment of a non-crush constant speed vacuum transport section 12 and a variable speed sheet feed section 13.

Detailed Description of Non-Crush Constant Speed Vacuum Transport Section 12:

With continuing reference to FIG. 3, FIG. 4, FIG. 7, FIG. 11, FIG. 12, and FIG. 14, one embodiment of a non-crush constant speed vacuum transport section 12 is shown.

Figure 7:
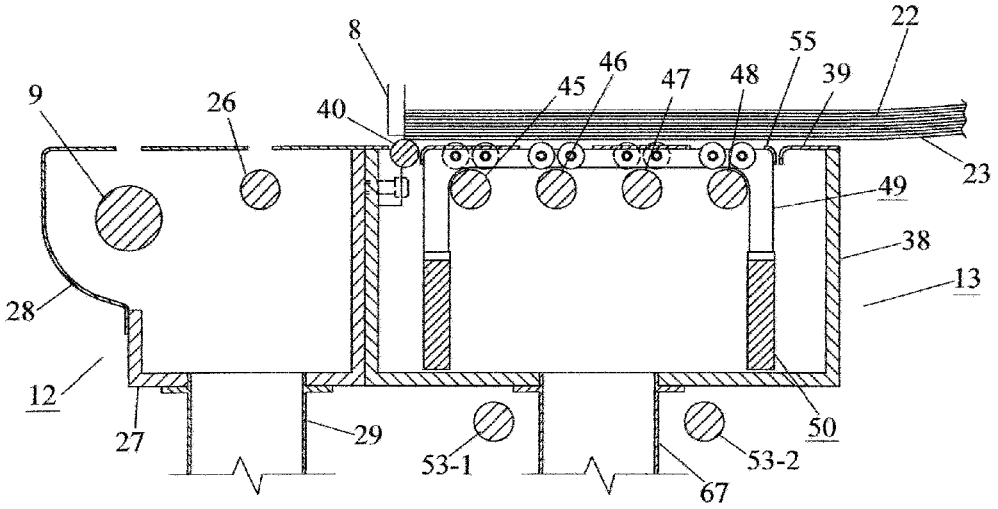
FIG. 7 is a cross-sectional view taken generally along lines 7-7 of FIG. 4 showing a feed interrupter of the variable speed feed section described herein.
Figure 9:
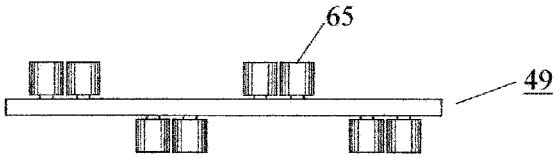
FIG. 9 is a plan view of the feed interrupter shown in FIG. 8.
Figure 8:
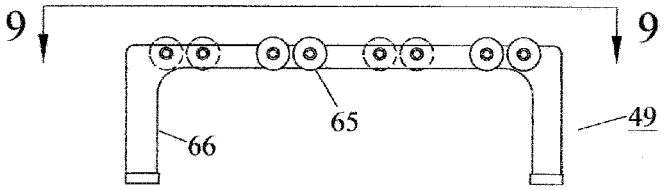
FIG. 8 is a side elevation of the feed interrupter shown in FIG. 7.

Refer to FIG. 3, FIG. 4, and FIG. 7, cover 28 forms the top of a vacuum chamber 27 in which a vacuum is produced through vacuum duct 29 communicating through the bottom of the chamber 27 with a vacuum blower, not shown. Vacuum chamber 27 is supported by vertical supports 31 and 32 which are suitable fixed to crossties of feed section 2, not shown. Cover 28 includes vacuum holes 36 for communicating the vacuum of vacuum chamber 27 to the underside of sheet 23.

Figure 12:
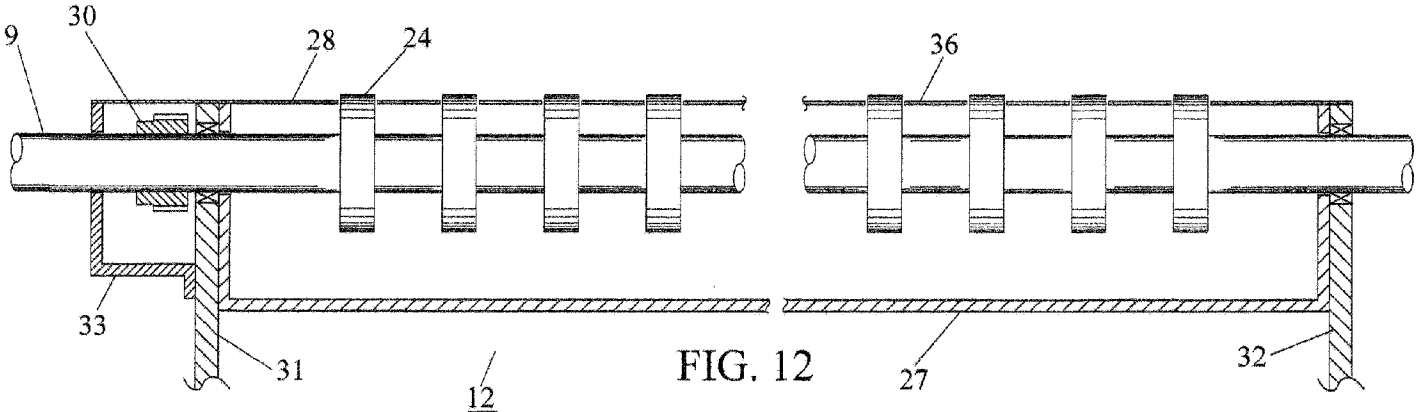
FIG. 12 is a cross-sectional view taken generally along lines 12-12 of FIG. 3, showing a plurality of a second set constant speed transfer wheels.

Referring to FIG. 2C, drive shaft 9 is supported to for rotation by machine drive pulley 14 in the side frames of feed section 2 by concentric bearing housings 19 and 20, and passes through support plates 31 and 32 and vacuum chamber 27. Referring to FIG. 3 and FIG. 12, a plurality of evenly spaced transport wheels 24 are fixed to drive shaft 9 and protrude through openings in vacuum chamber cover 28. The diameter of transport wheel 24 is equal to the diameter of replaced lower feed roll 6, for matching the surface speed of converting machine 1.

A plurality of evenly spaced transport wheels 25 are fixed to shaft 26 and protrude through openings in vacuum chamber cover 28. Shaft 26 is supported for rotation in support plates 31 and 32.

Figure 11:
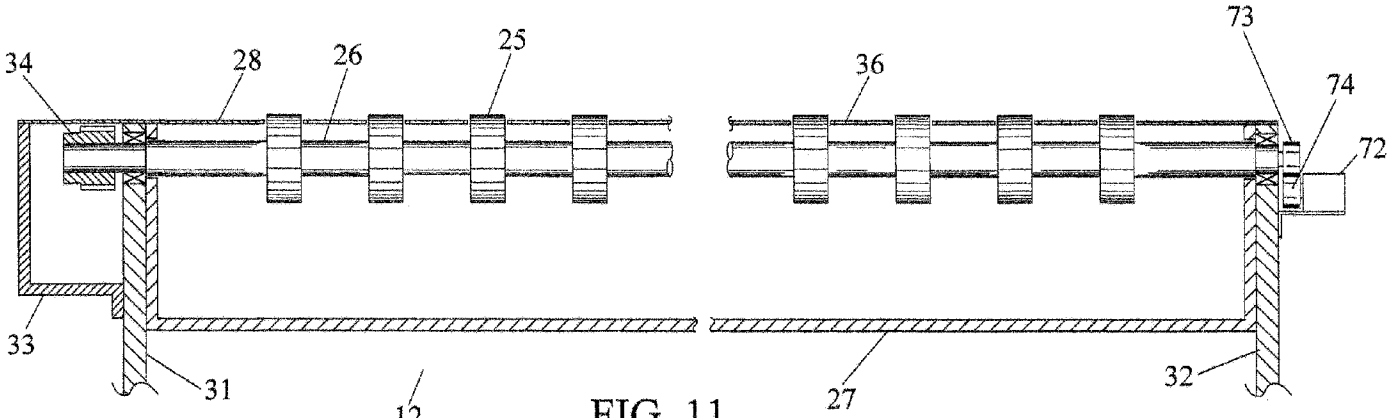
FIG. 11 is a cross-sectional view taken generally along lines 11-11 of FIG. 3, showing a plurality of a first set of constant speed transfer wheels.
Figure 14:
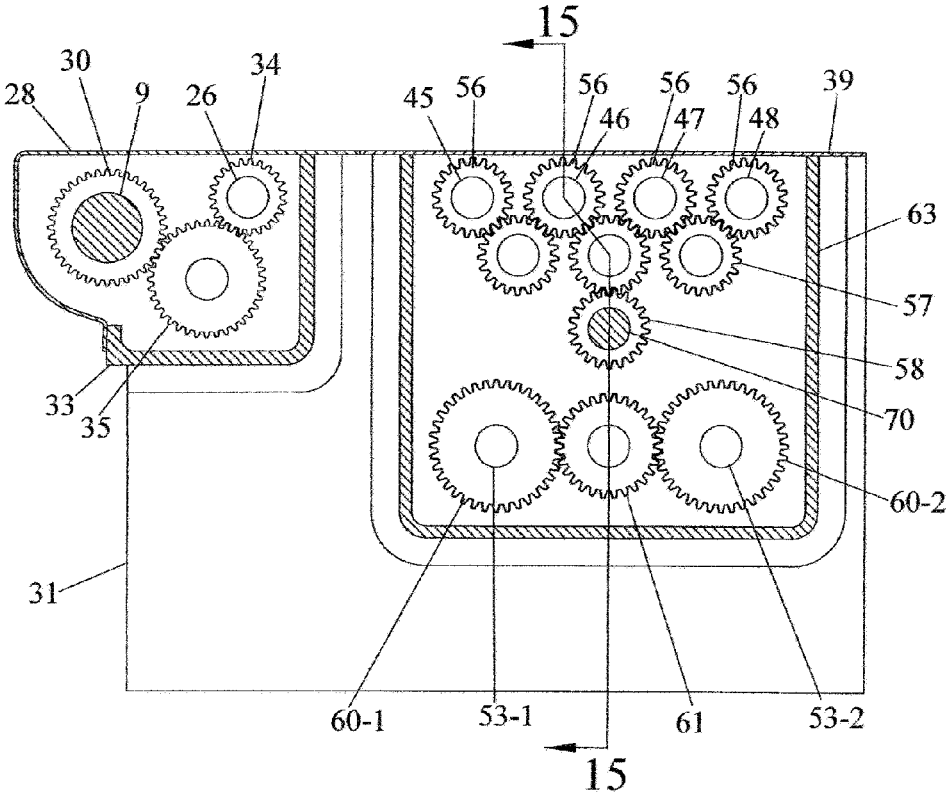
FIG. 14 is a cross-sectional view taken generally along lines 14-14 of FIG. 4, showing gear drive trains for constant speed transfer wheels, a gear drive for variable speed feed wheels, and a cam arrangement for raising and lowering a feed interrupter.
Figure 13:
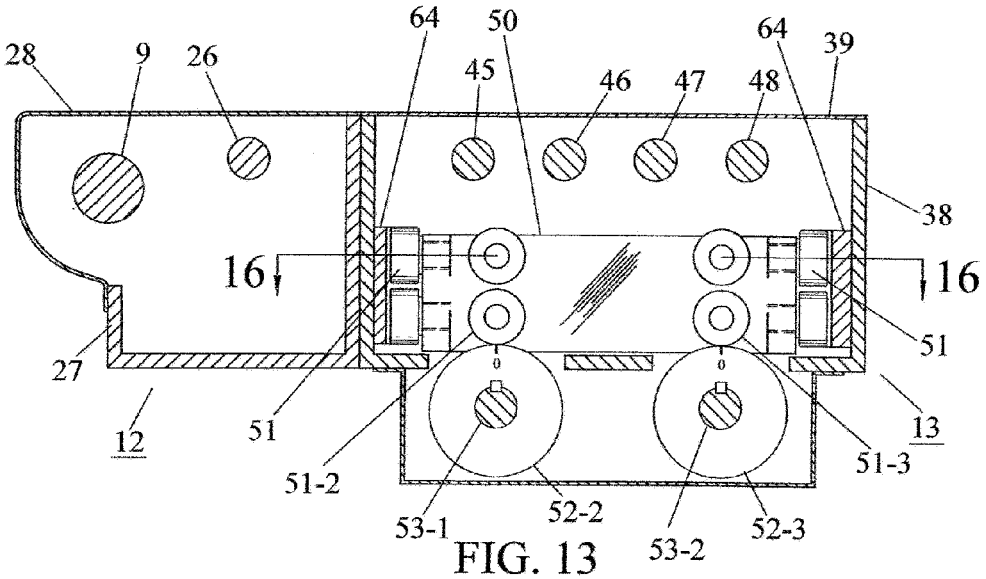
FIG. 13 is a cross-sectional view taken generally along lines 13-13 of FIG. 10, showing a cam arrangement for raising and lowering a feed interrupter.

Referring to FIG. 11, FIG. 12, and FIG. 14, drive shaft 9 drives transport wheels 25 through drive gear 30, idler gear 35, and driven gear 34 within gear case 33. The diameter of transport wheel 25 relative to the diameter of transport wheel 24 is equal to the ratio of the number of teeth on gear 34 to the number of teeth of gear 30, for matching the surface speed of converting machine 1. Transport wheels 24 and 25 are thereby driven by drive shaft 9 at the surface speed of the box machine 1.

Transport wheels 24 and 25 have a high friction surface for engaging the underside of sheet 23 for positively driving sheet 23 to printing section 3.

Referring to FIG. 11, resolver 72 is driven by drive shaft 9 through gears 30, 35, 34, shaft 26 and gears 73 and 74, for communicating with controller 77 for tracking the speed and position of the operating elements of box machine 1, which is driven by drive shaft 9 through drive gear 15 (FIG. 2C).

Detailed Description of Variable Speed Sheet Feed Section 13:

With continuing reference to FIG. 3, FIG. 4, FIG. 5, FIG. 6, FIG. 7, FIG. 8, FIG. 9, FIG. 10, FIG. 13, FIG. 14, FIG. 15, and FIG. 16, one embodiment of a variable speed feed section 13 is shown, which is particularly suited for retrofitting existing converting machines 1.

Figure 15:
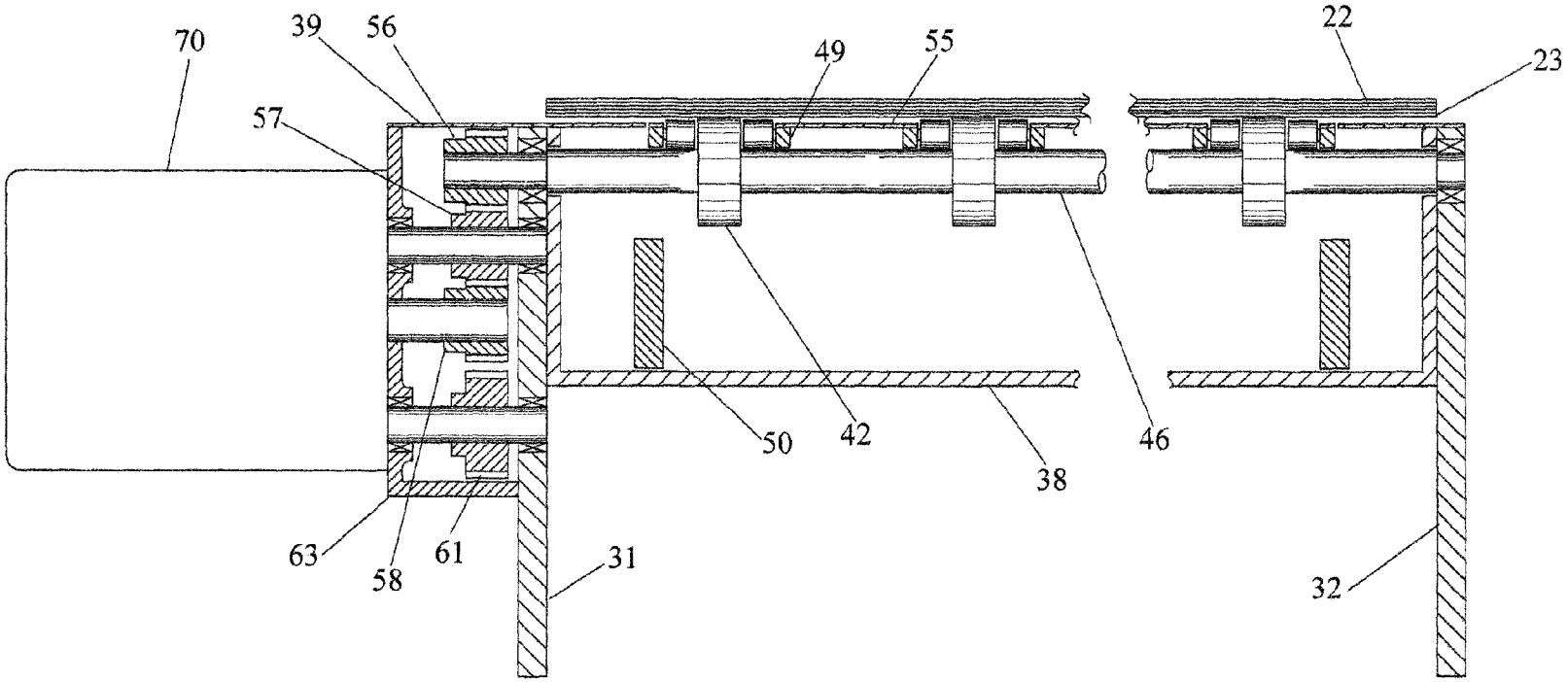
FIG. 15 is a cross-sectional view taken generally along lines 15-15 of FIG. 14, showing a gear drive for variable speed feed wheels, and an idler gear of the feed interrupt drive train.
Figure 16:
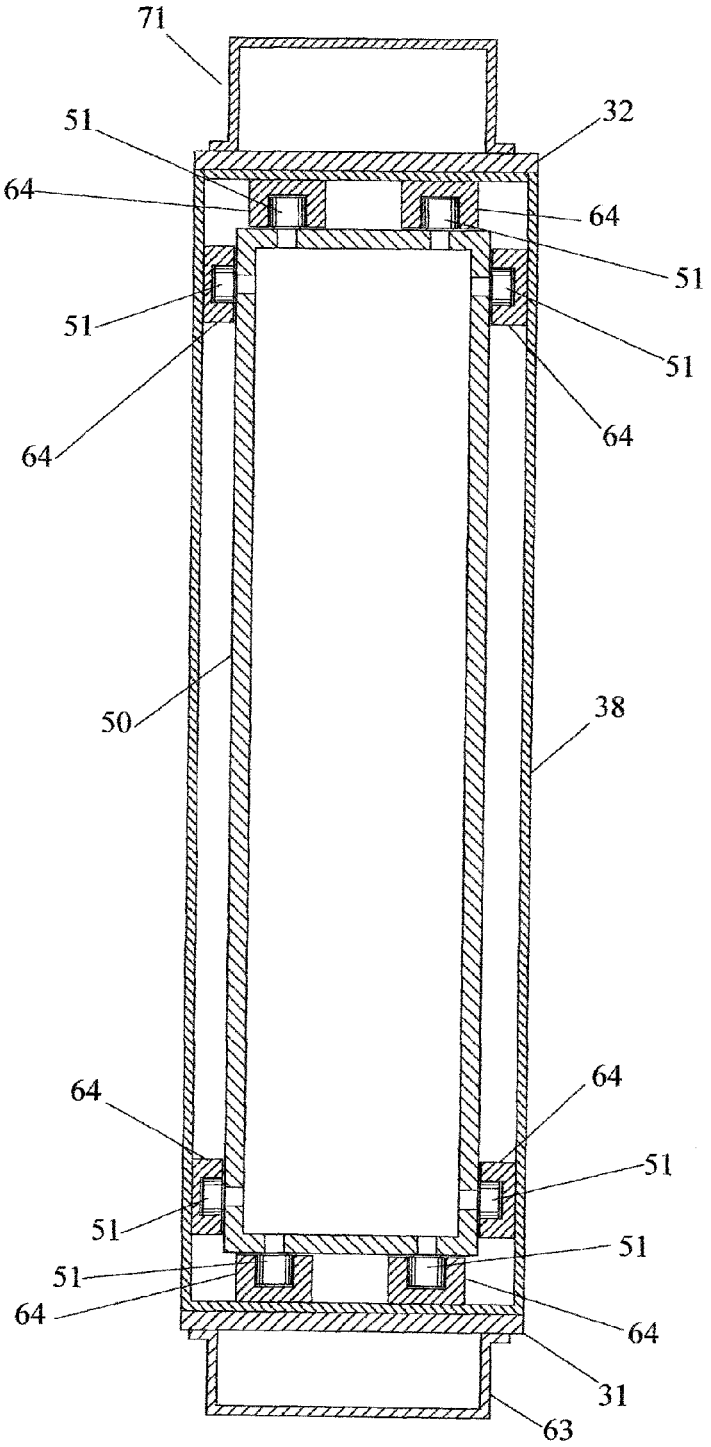
FIG. 16 is a cross-sectional view taken along lines 16-16 of FIG. 13, showing a support frame for a feed interrupt and associated vertical guide rollers.

Referring to FIG. 3, and FIG. 7, and FIG. 15, sheet stack 22 and lowermost sheet 23 are supported by feed wheels 41, 42, 43, and 44 which protrude above vacuum chamber 38 cover 39, through openings in interrupt cover 55.

Covers 39, 55 and vacuum chamber 38 define a chamber in which a vacuum is produced through vacuum duct 67 communicating with a vacuum blower, not shown. Cover 55 includes openings surrounding the protruding feed wheels for communicating the vacuum of vacuum chamber 27 to the underside of sheets 23. Vacuum chamber 38 is supported by vertical support plates 31 and 32 which are fixed to crossties, not shown, of feed section 2.

The front, or leading edge of sheet stack 22 is located by a vertical feed gate 8 and supported by support wheel assembly 40. The gap between feed gate 8 and support wheel assembly 40 is adjustable to permit passage of only a single sheet 23.

Figure 5:
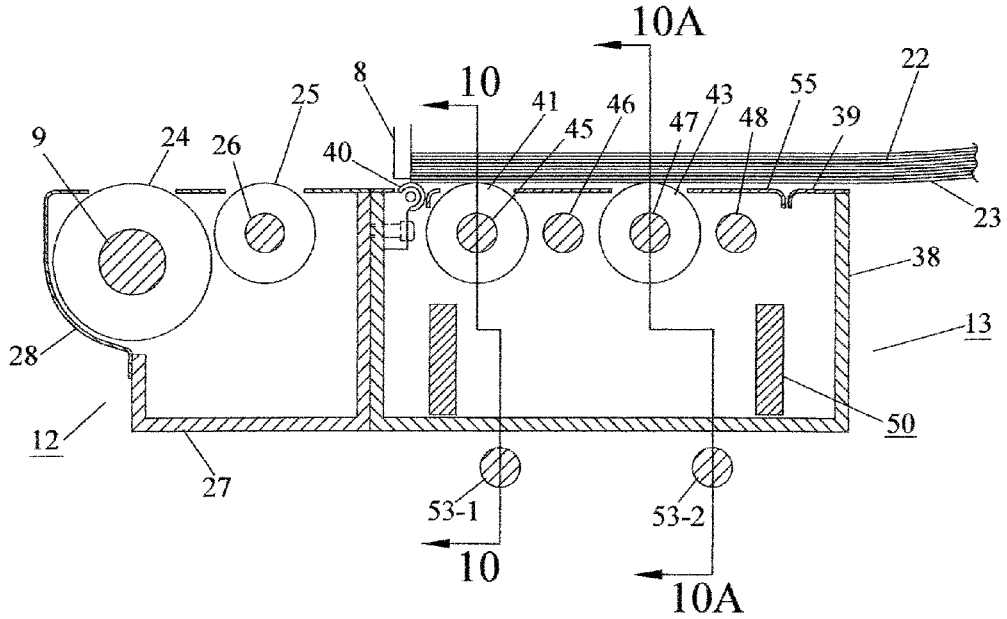
FIG. 5 is a cross-sectional view taken along lines 5-5 of FIG. 4 illustrating two constant speed transfer wheels in line with two variable speed feed rolls.
Figure 6:
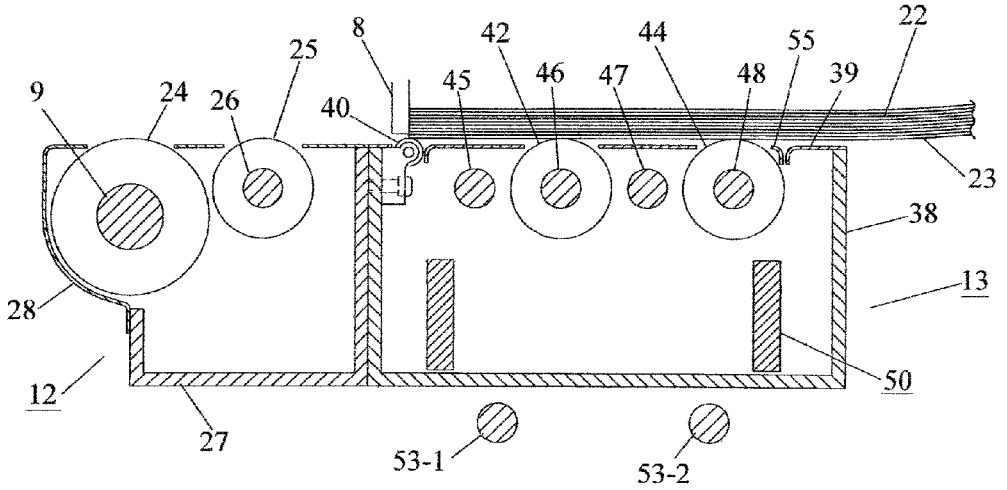
FIG. 6 is a cross-sectional view taken along lines 6-6 of FIG. 4, illustrating two constant speed transfer wheels in line with two variable speed feed rolls that are staggered from the variable speed feed wheels shown in FIG. 5.

Referring to FIG. 4, FIG. 5 and FIG. 6, feed wheels 41, 42, 43, and 44 are fixed to shafts 45, 46, 47, and 48 which are mounted for rotation in support plates 31 and 32.

The feed wheels 41, 42, 43, and 44 and shafts 45, 46, 47, and 48 are divided into two sets.

The first set (plurality) comprises shafts 45 with a plurality of feed wheels 41 and shaft 47 with a plurality of feed wheels 43. Feed wheels 41 and 43 are mounted in alignment.

The second set (plurality) comprises shafts 46 with a plurality of feed wheels 42 and shaft 48 with a plurality of feed wheels 44. Feed wheels 42 and 44 are mounted in alignment, but staggered with respect feed wheels 41 and 43, for conserving space in the feed direction.

Referring to FIG. 4, there are two inline feed wheels, either 41 and 43, or 42 and 44 for each two inline transfer wheels 24 and 25, whereby constant speed transport section 12 and variable speed feed section 13 each provide equal traction by driving sheet 23 with two in-line wheels.

With continuing reference to FIG. 3, FIG. 4, FIG. 14, and FIG. 15, a drive train for rotating feed wheels 41, 42, 43, and 44 is shown.

Referring to FIG. 3, FIG. 14 and FIG. 15, servo motor 70, for driving the rotation of feed wheels 41, 42, 43, and 44 is mounted to gear case 63 and supported by support plate 31. Drive gear 58 is fixed to the output shaft of servo motor 70 and drives idler gears 57 and gears 56. Gears 56 drive shafts 45, 46, 47 and 48 and thereby drive feed wheels 41, 42, 43, and 44.

Rotation of servo motor 70 is controlled by programmable controller 77.

With continuing reference to FIG. 3, FIG. 4, FIG. 7, FIG. 8, FIG. 9, FIG. 10, FIG. 15, and FIG. 16, feed interrupter 49, for interrupting contact of sheet 23 with feed wheels 41, 42, 43, and 44, is shown.

Referring to FIG. 4, FIG. 7, FIG. 8, FIG. 9, FIG. 10, and FIG. 10A, supported for vertical movement between a raised and lowered position is a plurality of feed interrupters 49 each comprising bracket 66, and wheels 65. When feed interrupters 49 are in a lowered position they cannot contact sheet 23 and sheet 23 is supported by feed wheels 41, 42, 43, and 44. When feed interrupters 49 are in a raised position, they contact the bottom of sheet 23 and support sheet 23 and stack 22 out of contact with feed wheels 41, 42, 43, and 44, to interrupt the feed of sheets 23.

Feed interrupters 49 straddle each feed wheel 41, 42, 43, and 44 (FIG. 4).

An interrupt cover 55 is fixed to brackets 66 of feed interrupters 49, with openings through which feed wheels 41, 42, 43, and 44 protrude. Interrupt cover 55 along with cover 39 form the top of vacuum chamber 38 in which a vacuum is produced through vacuum duct 67 (FIG. 7) connecting through the bottom of chamber 38 with a vacuum blower, not shown. Vacuum chamber 38 is supported on vertical supports 31 and 32 which are suitable fixed to crossties (not shown) of feed section 2. The openings through which feed interrupters 49 and feed wheels 41, 42, 43, and 44 protrude communicate the vacuum of vacuum chamber 38 to the underside of sheet 23.

With continuing reference to FIG. 3, FIG. 4, FIG. 7, FIG. 10, FIG. 10A, FIG. 13, FIG. 14, and FIG. 16, the mechanism by which feed interrupters 49 are moved vertically between an up and down position is shown.

Referring to FIG. 3, FIG. 4, FIG. 7 and FIG. 10, FIG. 10A and FIG. 13, and FIG. 16, a plurality of feed interrupters 49 are supported by interrupt frame 50. Frame 50 supports eight sets of a pair of vertically arranged guide rollers 51. Each set of vertically arranged pair of guide rollers 51 ride in eight vertical guides 64 fixed to vacuum chamber 38. There are two sets of guide rollers 51 fixed to each side and to each end of frame 50. Frame 50 and feed interrupters 49 are, thereby, confined to vertical movement.

Frame 50 and feed interrupters 49 are supported for vertical movement by four lower guide rollers 51 designated as 51-1, 51-2, 51-3, and 51-4 fixed to the ends of frame 50. Guide rollers 51-1, 51-2, 51-3, and 51-4 are supported on the surface of four cams 52-1, 52-2, 52-3, and 52-4 which are fixed to two parallel cam shafts 53-1 and 53-2. Cam shafts 53-1 and 53-2 are supported for rotation in support plates 31 and 32. Rotation of cam shafts 53-1 and 53-2 will result in vertical movement of frame 50 and feed interrupters 49.

Referring to FIG. 10, FIG. 10A, FIG. 13, and FIG. 14, cam servo motor 69 is mounted to motor support 71 fixed to support plate 32. The output shaft of servo motor 69 is coupled to cam drive shaft 53-1 by coupling 68. Cam shaft 53-1 is supported for rotation in support plates 31 and 32. Cams 52-1 and 52-2 are fixed to cam shaft 53-1. Drive gear 60-1 is fixed to drive shaft 53-1 and drives idler gear 61 (FIG. 14) and drive gear 60-2 fixed to cam drive shaft 53-2. Cams 52-3 and 52-4 are fixed to drive shaft 53-1. Cam shaft 53-2 is supported for rotation in support plates 31 and 32. Cams 52-1, 52-2, 52-3, and 52-4 are mounted in synchronized alignment.

Rotation of servo motor 69 will thereby rotate cams 52-1, 52-2, 52-3, and 52-4 in synchronism. The contour of cams 52-1, 52-2, 52-3, and 52-4 is such that a first one-half revolution of the cams will raise frame 50 and feed interrupters 49 from a lowered, feed, position to a raised, stop-feed, position due to the surface contact between guide rollers 51-1, 51-2, 51-3, and 51-4 and cams 52-1, 52-2, 52-3, and 52-4.

A second one-half revolution of the cams 52-1, 52-2, 52-3, and 52-4 will lower frame 50 and feed interrupters 49 from a raised, stop-feed, position to a lowered, feed, position due to the surface contact between guide rollers 51-1, 51-2, 51-3, 51-4 and cams 52-1, 52-2, 52-3, and 52-4.

The magnitude of movement of feed interrupters 49 from the lowered position to the raised position in practice may be approximately 0.125" for 180 degree rotation of the cams 52-1, 52-2, 52-3, and 52-4, providing a gentile and smooth transition from raised and lowered positions.

When feed interrupters 49 are in the lowered feed position, sheet 23 engages feed wheels 41, 42, 43, and 44 to be positively driven under feed gate 8 and to constant speed transport section 12.

When feed interrupters 49 are in the raised, stop-feed position, feed interrupters 49 contact and support sheet 23 and stack 22 out of engagement with feed wheels 41, 42, 43, and 44 to stop the feeding of sheet 23, and to prevent contact of feed wheels 41, 42, 43, and 44 with the next lowermost sheet in stack 22.

Figure 20:
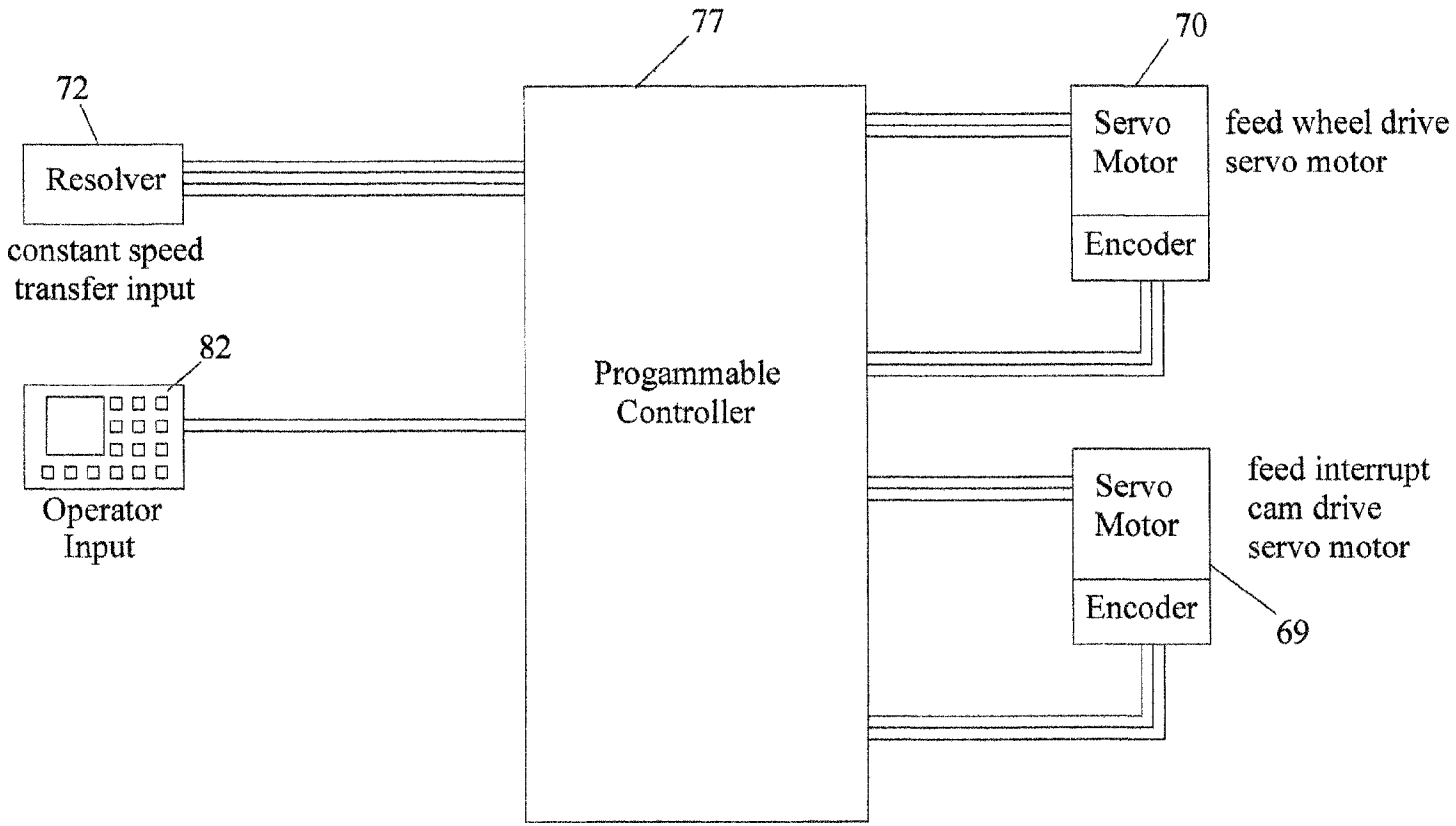
FIG. 20 is a diagram showing the inter-connections between a programmable controller, a resolver, an operator input, and servo motors for controlling feed wheels and a feed interrupter.

Rotation of servo motor 69 is controlled by programmable controller 77 (FIG. 20).

Referring to FIG. 20, FIG. 11 and FIG. 14, Drive shaft 9 drives the gear train of box machine 1 through drive gear 15, and resolver 72 through a drive train of drive gear 30, idler 35, gear 34, shaft 26, gear 73, and gear 74, whereby resolver 72 may track and communicate the relative rotation and velocity of a main cylinder of the box machine, which may be a print cylinder, a die-cutting cylinder, or a slotting head cylinder, to programmable controller 77 (FIG. 20). Feed wheel servo motor 70 encoder communicates the rotation and velocity of feed wheels 41, 42, 43, and 44 to programmable controller 77 (FIG. 20). Feed interrupt cam drive servo motor 69 encoder communicates the position of feed interrupt cams feed wheels 41, 42, 43, and 44 to programmable controller 77 (FIG. 20). Operator input 82 communicates input such as the length of sheet 23 and regular feed, to programmable controller 77. Programmable controller 77 thereby calculates and controls the rotation of feed wheels 41, 42, 43, and 44 through feed wheel servo motor 70, and the position of feed interrupters 49 through feed interrupt cam drive servo motor 69.

Operation:

Referring to FIG. 1C, at the time of installation variable speed sheet feeder section 13 is configured for operation to match the repeat length of box machine 1. The repeat length of a box machine is the circumferential length of a main cylinder of the box machine which cylinder may be a printing cylinder, a die cutting cylinder, or a slotting head. In general, a box machine repeat length may any length, but generally can be 24, 35, 36, 37, 50, 66, 96 inches, for instance, or other designated repeat lengths. A typical U.S. box plant may have box machines with 35, 50 and 66 inch repeat lengths, for instance.

Conventional corrugated paperboard sheet feeders such as U.S. Pat. No. 5,184,811 to Sardella, U.S. Pat. No. 6,824,130 to Sardella, U.S. Pat. No. 4,896,872 to Sardella, and U.S. Pat. No. 4,828,244 to Sardella operate at one predetermined repeat length. A different model variable speed sheet feeder is required to be retrofitted to box machines with 35, 50, and 66 inch repeat lengths, for instance.

A variable speed sheet feeder section 13 of the present invention, in comparison, can be programmed to operate with any machine repeat size, providing economy in manufacturing.

Referring to FIG. 20, during installation of variable speed sheet feeder 13, programmable controller 77 is programmed to operate with the repeat length of box machine 1. After the initial programming of programmable controller 77, the feeder may be put into production.

Figure 17:
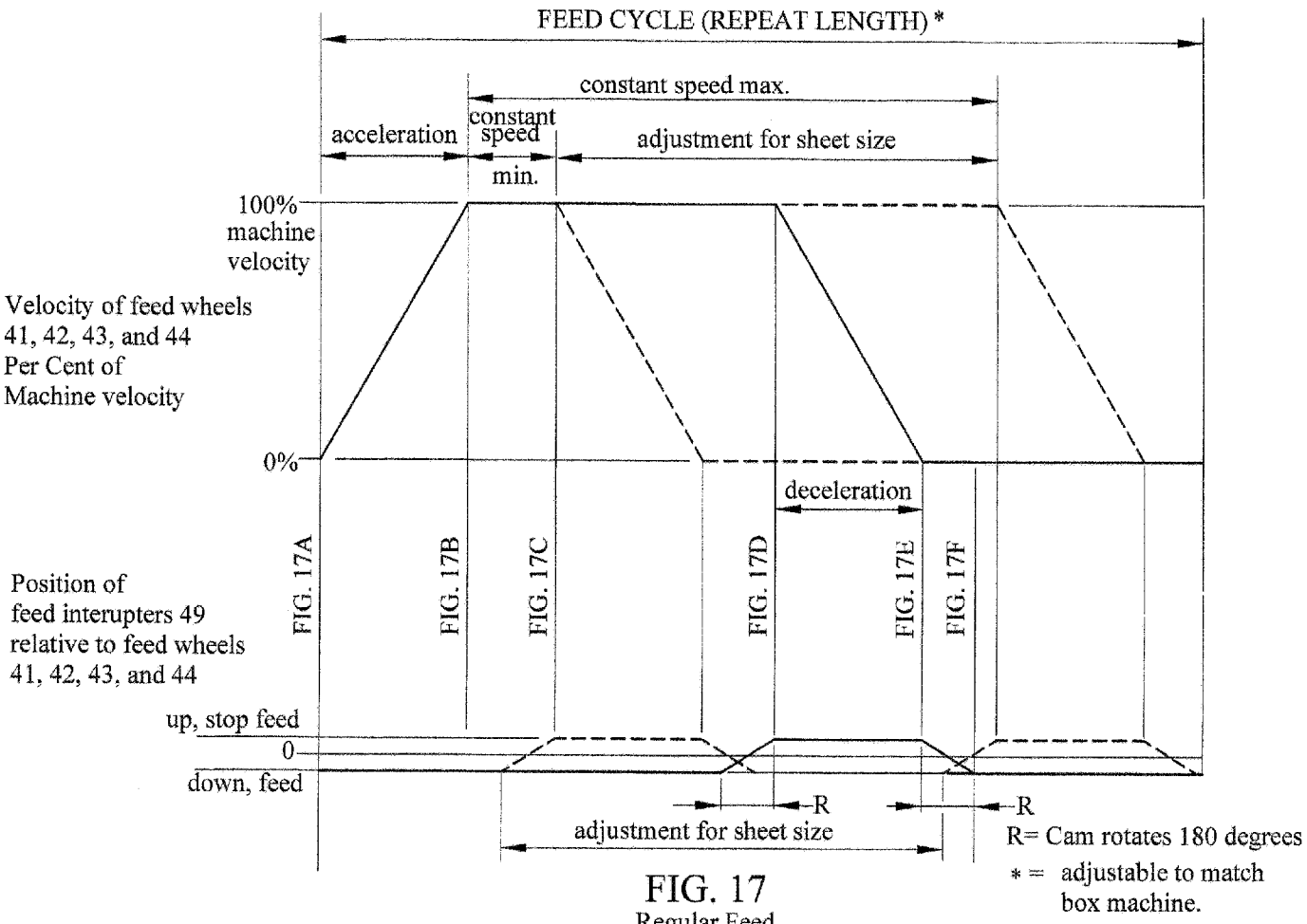
FIG. 17 is a diagram showing the relationship between variable speed feed wheels and the position of a feed interrupter through a single-feed operation of the one feed cycle.
Figure 17A:
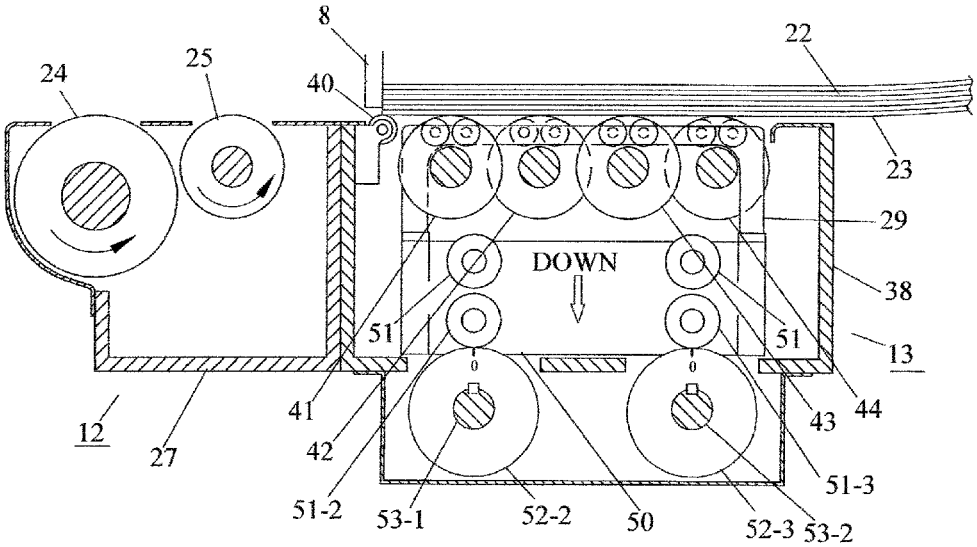
FIGS. 17A, 17B, 17C, 17D, 17E, and 17F are sequential sketches showing the relationship between a sheet and the position of a feed interrupter during a single-feed feed cycle.
Figure 17B:
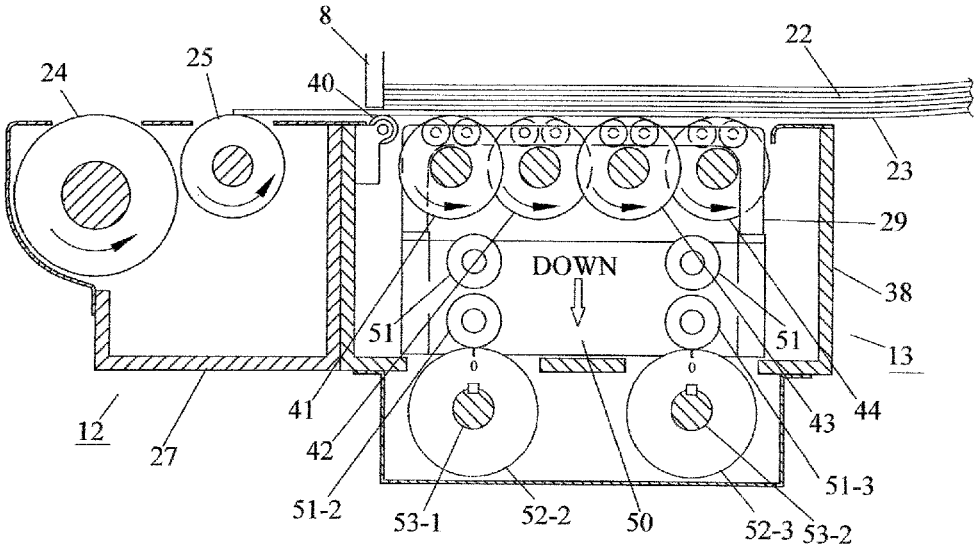
Figure 17C:
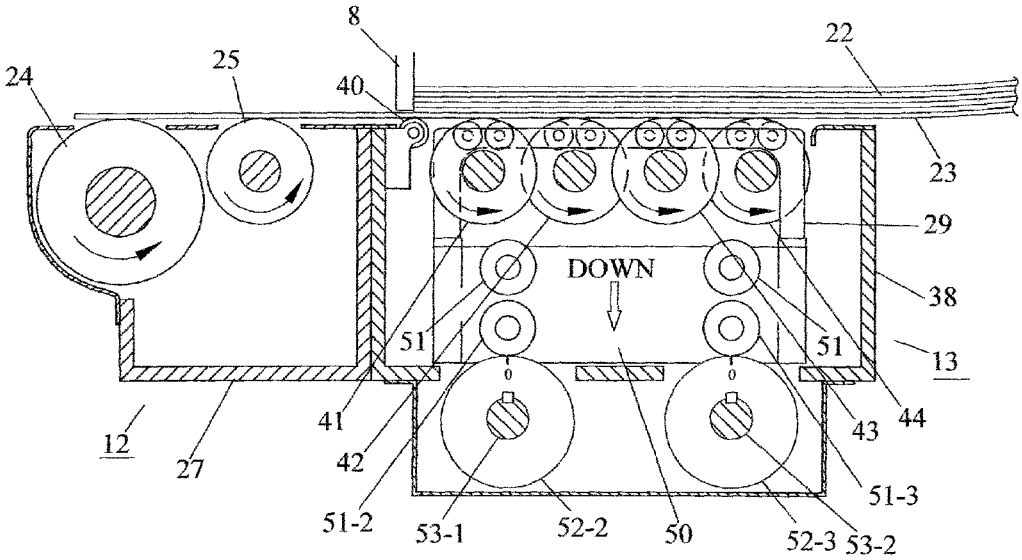
Figure 17D:
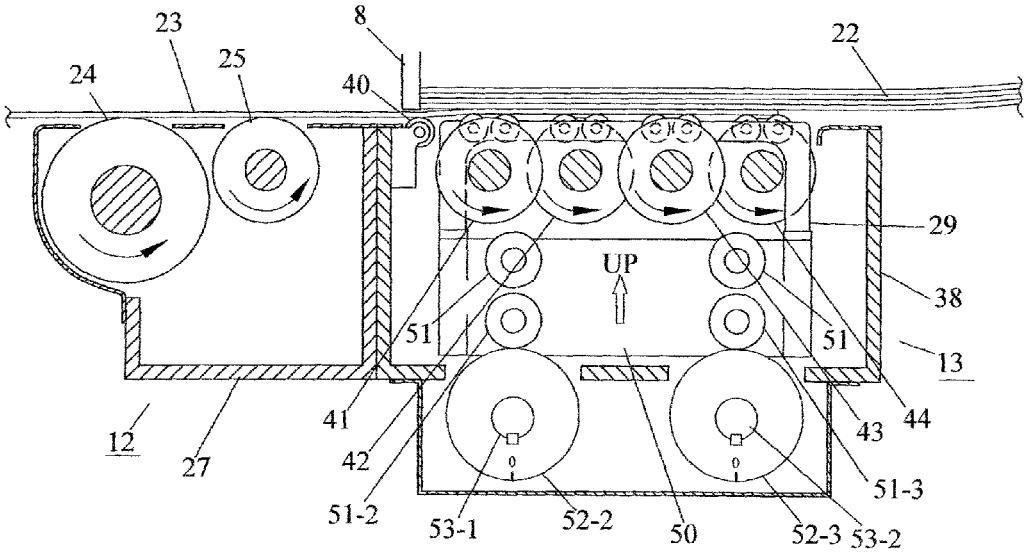
Figure 17E:
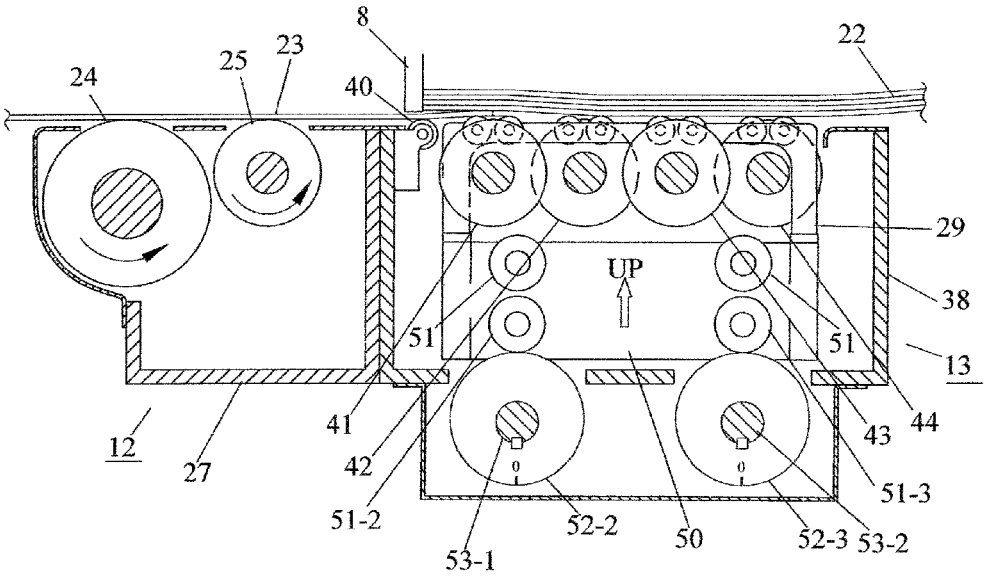
Figure 17F:
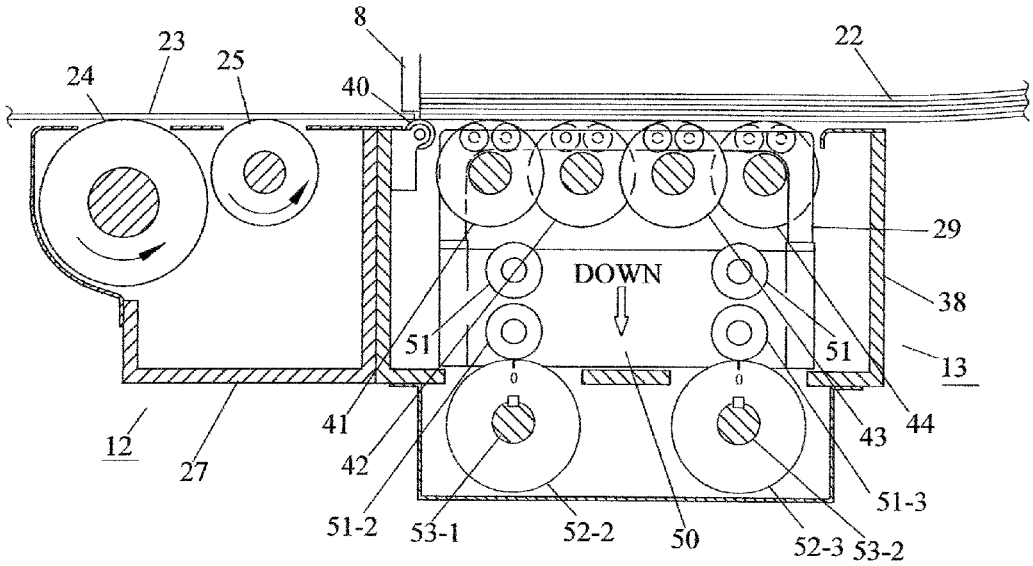

With continued reference to FIG. 17, FIG. 17A, FIG. 17B, FIG. 17C, FIG. 17 D, FIG. 17E, and FIG. 17F, It is known that corrugated paperboard sheet feeders such as U.S. Pat. No. 5,184,811 to Sardella, U.S. Pat. No. 6,824,130 to Sardella, U.S. Pat. No. 4,896,872 to Sardella, and U.S. Pat. No. 4,828,244 to Sardella may provide different modes of operation, such as, feed one sheet per feed cycle (regular feed), feed two sheets per feed cycle (dual feed), feed one sheet for two feed cycles (skip feed), feed one sheet on demand (during set-up), and stop feed on demand (in an emergency). All of these prior art disclosures require additional mechanical components for each additional mode of operation, whereby each additional mode of operation adds manufacturing expenses.

Referring to FIG. 20, for comparison, programmable controller 77 may be programmed to provide different modes of operation, such as, feed one sheet per feed cycle (regular feed), feed two sheets per feed cycle (dual feed), feed one sheet for two feed cycles (skip feed), feed one sheet on demand (during set-up), and stop feed on demand (in an emergency). Each additional mode of operation requires no additional mechanical components, and no increased manufacturing expenses.

Machine operation begins with the operator entering the sheet size and selects feeding one sheet for one box machine cycle (regular feed), for instance, at operator station 82 (FIG. 20). Vacuum blowers, not shown, are actuated for maintaining a constant vacuum pressure in vacuum chambers 27, and 38 of sheet feed section 13 and vacuum transport section 12 (FIG. 3) to be communicated to the underside of sheet 23.

Box machine drive motor, not shown, is activated driving machine drive pulley 14, drive shaft 9, constant speed transfer wheels 24, transport section drive gear 30, and machine drive gear 15. Machine drive gear 15 drives the main gear train of the box machine through a gears mesh, not shown, at a constant speed. (FIG. 2C).

Referring to FIG. 2C and FIG. 14, FIG. 11, and FIG. 12, drive shaft 9 drives constant speed transport wheels 25 through the gear mesh between transport drive gear 30, idler gear 35, and gear 34 fixed to transport wheel shaft 26, whereupon constant speed transfer wheels 24 and 25 rotate at constant speed.

Referring to FIG. 14 and FIG. 15, feed wheel servo motor 70 is activated to be controlled by programmable controller 77 (FIG. 20) for driving feed wheels 44, 42, 43, and 44 through the mesh of drive gear 58, idlers 57, and gears 56, thereby driving shafts 45 and 47 (FIG. 5) and shafts 46 and 48 (FIG. 6).

Figure 10:
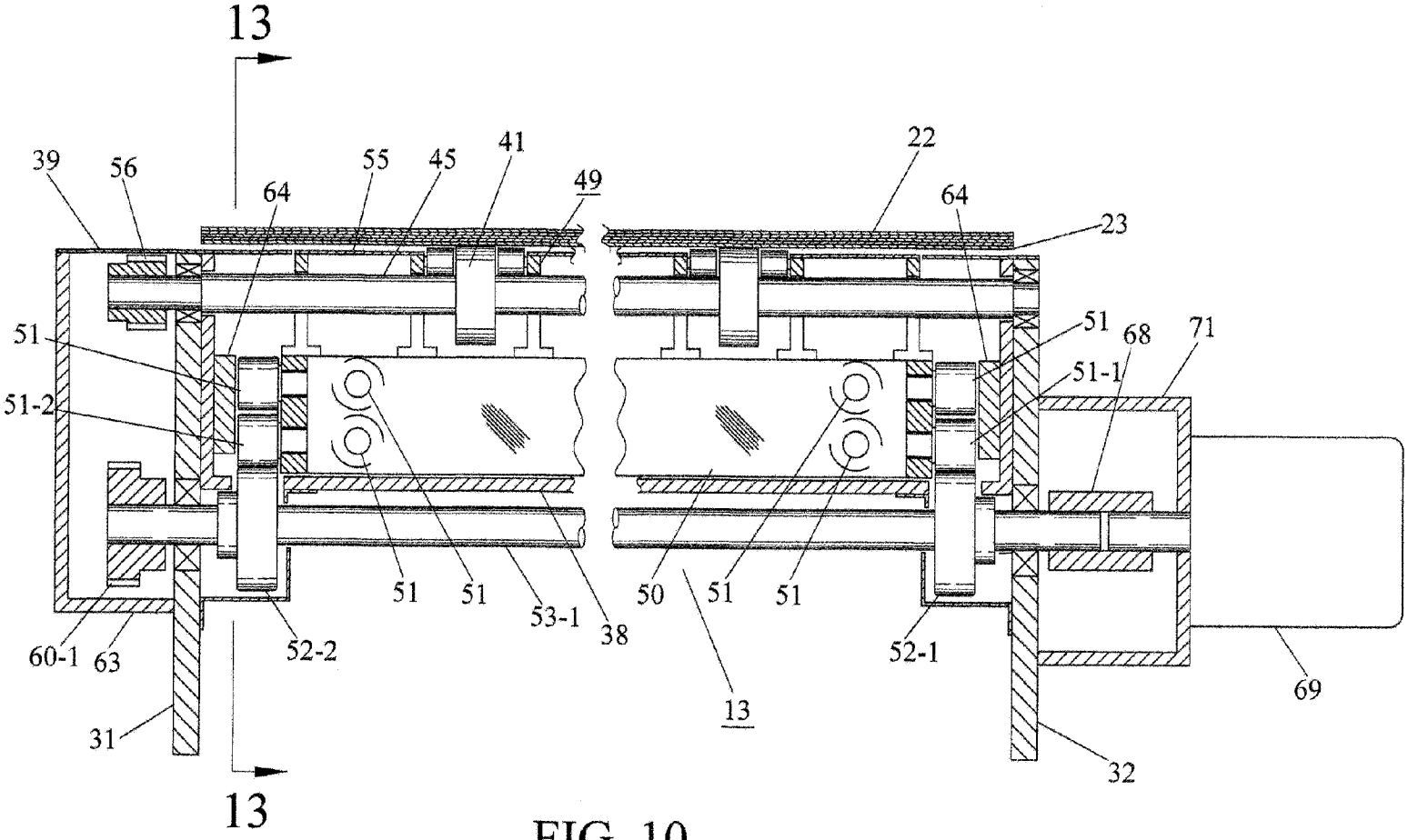
FIG. 10 is a cross-sectional view taken generally along lines 10-10 of FIG. 5 showing drive elements for a first set of feed interrupter cams.
Figure 10A:
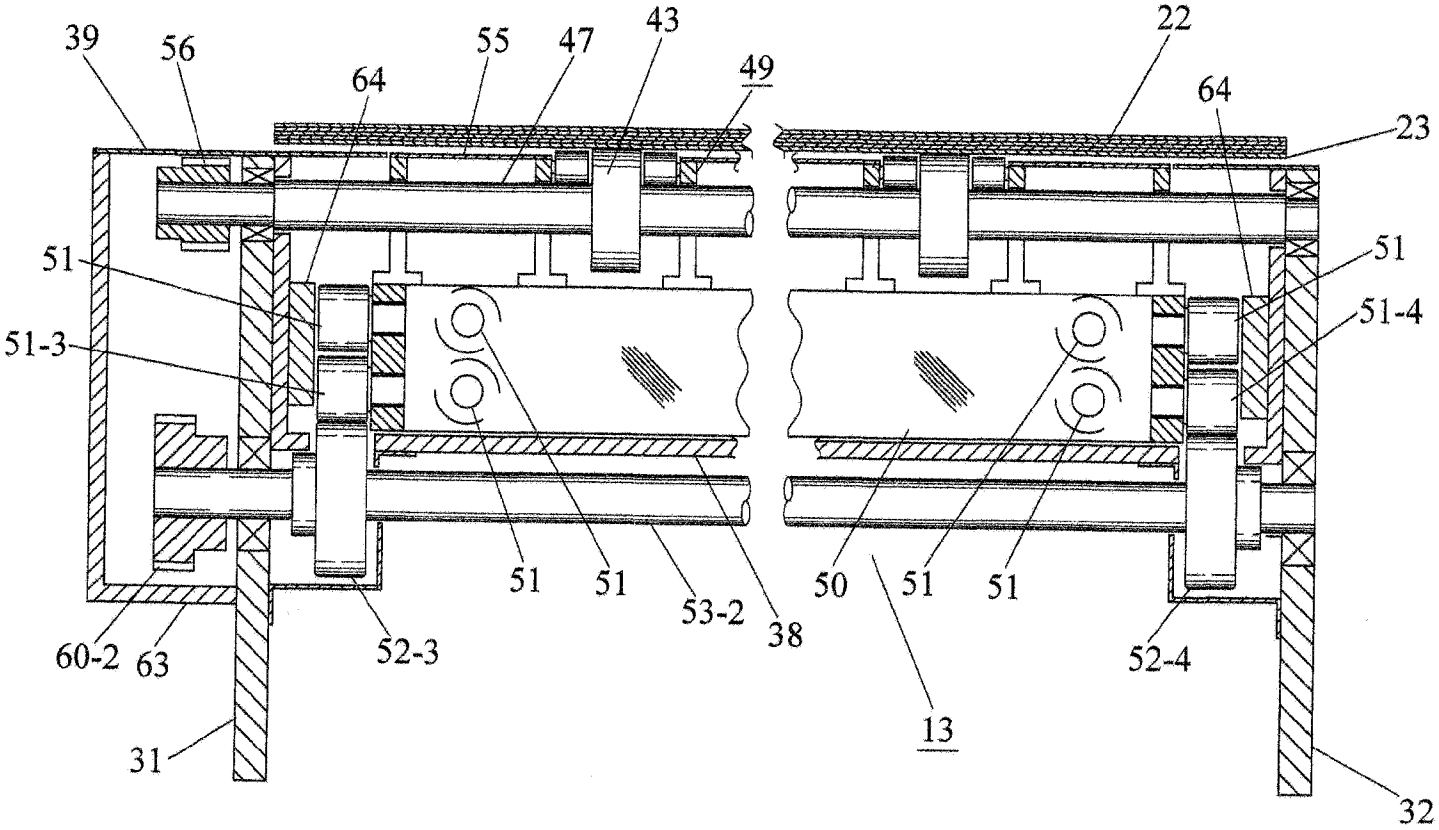
FIG. 10A is a cross-sectional view taken generally along lines 10A-10A of FIG. 5 showing drive elements for a second set of feed interrupter cams.

Referring to FIG. 14 and FIG. 10, cam drive servo motor 69 is activated to be controlled by programmable controller 77 (FIG. 20) for rotating feed interrupt cams 52-2, 52-2, 52-3, and 52-4 through rotation of shaft 53-1 and the gear mesh of drive gear 60-1, idler 61, and gear 60-2, thereby driving shafts 53-1 and 53-2 (FIG. 15) to rotate cams 52-2, 52-2, 52-3, and 52-4 in synchronism to raise and lower feed interrupters 49 (FIG. 10 and FIG. 10A)

Referring to FIG. 17, a diagram illustrating the velocity of feed wheels 41, 42, 43, and 44 relative to the velocity of box machine 1, feeding one sheet for one box machine cycle (regular feed), and the relative position of feed interrupters 49 is shown.

Referring to FIG. 17A, FIG. 178, FIG. 17C, FIG. 17D, FIG. 17E, and FIG. 17F sketches illustrating significant steps through the operation of one feed cycle of FIG. 17 are illustrated.

The direction of feed is illustrated in FIG. 4 by arrow 76.

Referring to FIG. 17 and FIG. 17A, schematic 17A illustrates the conditions at the beginning of a feed cycle. Constant speed transfer wheels 24 and 25 rotate at machine speed. Feed wheels 41, 42, 43, and 44 are at zero velocity and begin an acceleration segment from zero velocity to 100% of the velocity of the box machine. Feed interrupters 49 are in a down, feed, position. Feed wheels 41, 42, 43, and 44 contact sheet 23 with vacuum traction.

Referring to FIG. 17 and FIG. 178, constant speed transfer wheels 24 and 25 rotate at machine speed, feed wheels 41, 42, 43, and 44 end the acceleration segment, the leading edge of sheet 23 contacts constant speed transfer wheels 25, feed wheels 41, 42, 43, and 44 begin a constant speed segment. Feed interrupters 49 are n the down, feed, position. Feed wheels 41, 42, 43, and 44 contact and drive sheet 23 with vacuum traction.

Referring to FIG. 17 and FIG. 17C, constant speed transfer wheels 24 and 25 rotate at machine speed, the leading edge of sheet 23 covers vacuum chamber 27 whereby constant speed transfer wheels 24, and 25 acquire maximum vacuum traction, and drive sheet 23. Feed interrupters 49 are in the down, feed, position. Feed wheels 41, 42, 43, and 44 contact and drive sheet 23 with vacuum traction and continue at constant speed. Sheet 23 is driven by a plurality of wheels 41, 42, 43, and 44, and an equal plurality of wheels 24 and 25 (FIG. 4).

Referring to FIG. 17 and FIG. 17D, constant speed transfer wheels 24 and 25 rotate at machine speed, sheet 23 covers vacuum chamber 27 whereby constant speed transfer wheels 24, and 25 drive sheet 23 with maximum vacuum traction. The trailing edge of sheet 23 has reached feed wheel 44. Feed interrupters 49 raise to an up, stop-feed, position. Feed wheels 41, 42, 43, and 44 do not contact sheet 23. Feed wheels 41, 42, 43, and 44 begin a deceleration segment. Sheet 23 is driven by transfer wheels 24 and 25.

Referring to FIG. 17 and FIG. 17E, constant speed transfer wheels 24 and 25 rotate at machine speed, sheet 23 covers vacuum chamber 27 whereby constant speed transfer wheels 24, and 25 drive sheet 23 with maximum vacuum traction. The trailing edge of sheet 23 has reached feed wheel 41. Feed interrupters 49 are in the up, stop-feed, position. Feed wheels 41, 42, 43, and 44 do not contact sheet 23. Feed wheels 41, 42, 43, and 44 end their deceleration segment, and dwell at zero velocity until the end of the feed cycle. Feed interrupters 49 are in the up, stop-feed, position and prevent contact between feed wheels 41, 42, 43, and 44 and the next lowermost sheet in stack 22. Sheet 23 is driven by transfer wheels 24 and 25.

Referring to FIG. 4, FIG. 17 and FIG. 17F, constant speed transfer wheels 24 and 25 rotate at machine speed, sheet 23 covers vacuum chamber 27 whereby constant speed transfer wheels 24, and 25 drive sheet 23 with maximum vacuum traction. The trailing edge of sheet 23 has passed sheet stack 22. Feed interrupters 49 are in the down, feed, position. Feed wheels 41, 42, 43, and 44 contact the lowermost sheet of stack 22, and dwell at zero velocity until the end of the feed cycle. Sheet 23 is driven by transfer wheels 24 and 25.

Figure 18:
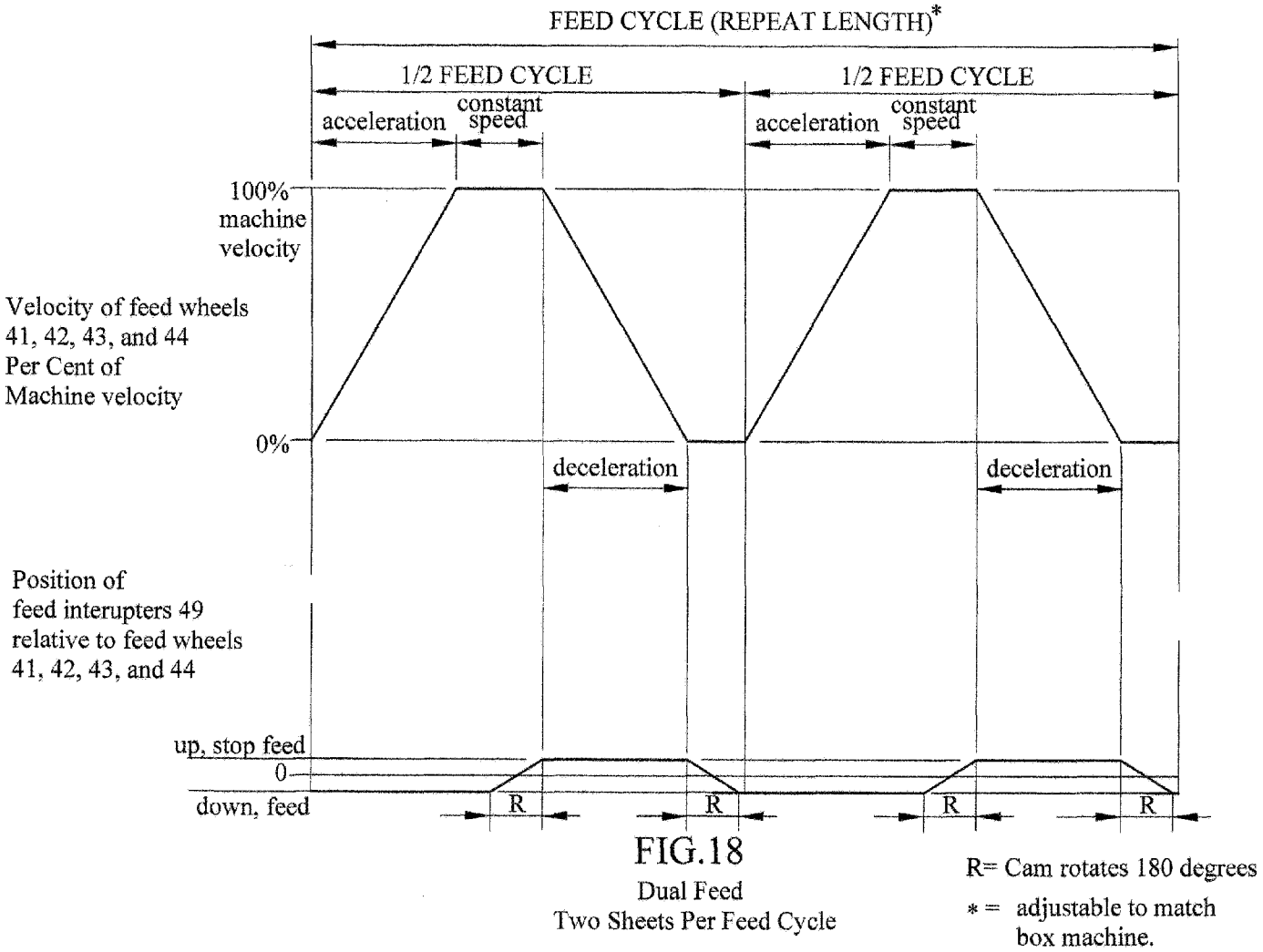
FIG. 18 is a diagram showing the relationship between variable speed feed wheels and the position of a feed interrupter during a dual-feed feed cycle.

Referring to FIG. 18, a diagram showing the relationship between feed wheels 41, 42, 43, 44, and feed interrupters 49 during a dual feed operation is shown. Two sheets 23 are fed during one cycle of the box machine in this mode of operation. Dual feed may be used when the length of sheet 23 is less than one-half the repeat length of the box machine. Dual feeding doubles the production rate of such sheets relative to feeding one sheet 23 per feed cycle.

Controller 77 may be configured to control feed wheels 41, 42, 43, 44, and feed interrupters 49 to operate in a dual feed mode. No additional mechanical components are required, as on conventional sheet feeders. The machine operator need only select dual feeding at operator input station 82 to access this mode of operation.

Figure 19:
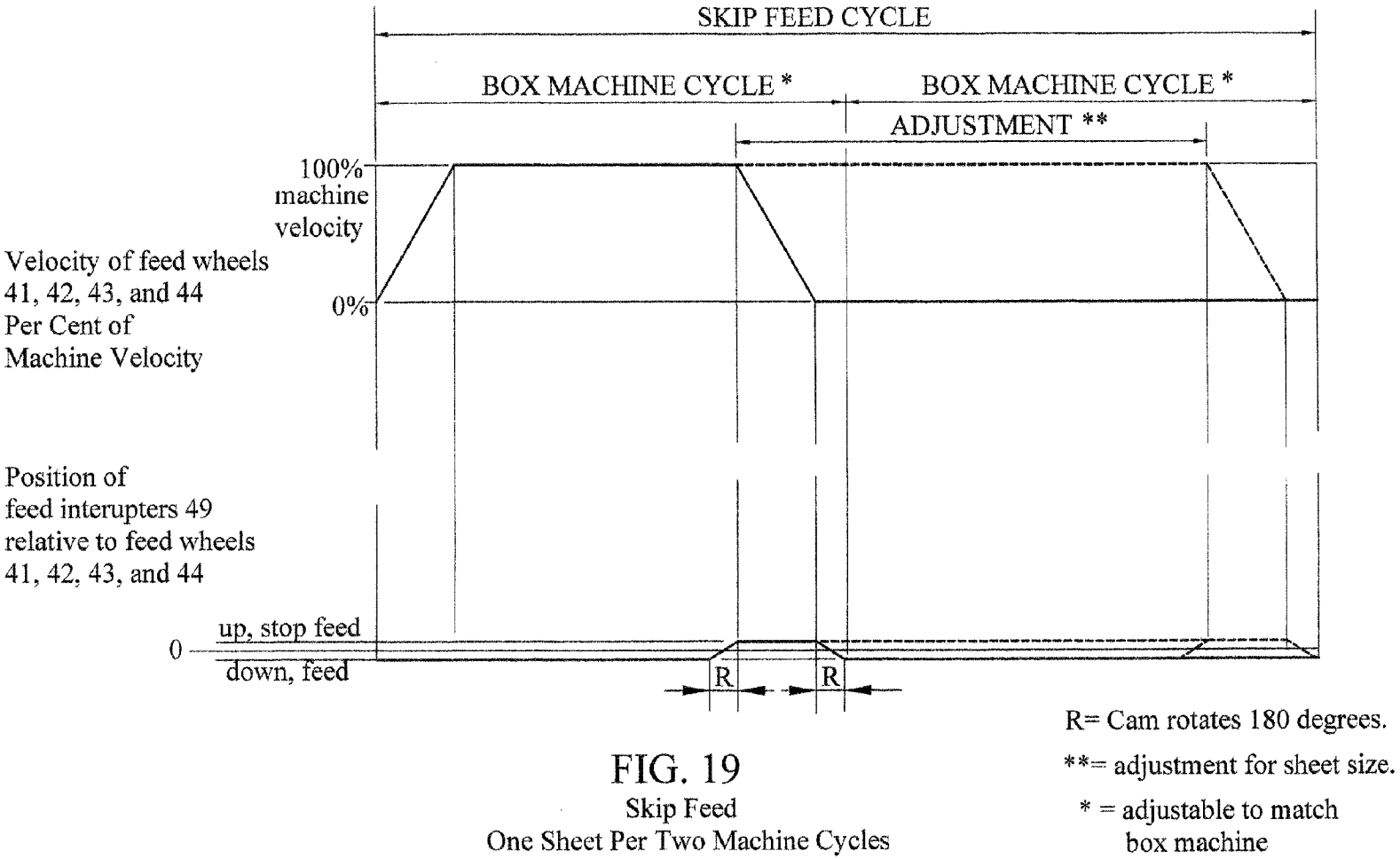
FIG. 19 is a diagram showing the relationship between variable speed feed wheels and the position of a feed interrupter during a skip-feed feed cycle.

Referring to FIG. 19, a diagram showing the relationship between feed wheels 41, 42, 43, 44, and feed interrupters 49 during a skip-feed operation of the present invention is shown. One sheet 23 is fed during two cycles of the box machine in this mode of operation.

Skip feed may be used when the length of sheet 23 is greater than the repeat length of the box machine 1. Skip feeding halves the production rate of such sheets relative to feeding one sheet 23 per feed cycle, but enables sheets 23 greater than the repeat length of the box machine to be processed.

Controller 77 may be configured to control feed wheels 41, 42, 43, 44, and feed interrupters 49 to operate in a skip feed mode. No additional mechanical components are required. The machine operator need only select skip feeding at operator input station 82 to access this mode of operation.

Referring to FIG. 20, a diagram showing the inter-connections between programmable controller 77, resolver 72, operator input 82, servo motor 70 for controlling feed wheels 41, 42, 43, 44, and servo motor 69 for controlling feed interrupters 49 are shown.

Controller 77 may be configured to control feed wheels 41, 42, 43, 44, and feed interrupters 49 to feed one sheet per feed cycle, two sheets per feed cycle, one sheet for two feed cycles, emergency stop feed, and to feed individual sheets on demand during set-up, all with no additional mechanical machine elements. The machine operator needs only to select the mode of operation and the size of sheet 23 at operator input station 82.

Although, a specific improved embodiment is shown, the apparatus of corrugated paperboard sheet feeders such as U.S. Pat. No. 5,184,811 to Sardella, U.S. Pat. No. 6,824,130 to Sardella, U.S. Pat. No. 4,896,872 to Sardella, and U.S. Pat. No. 4,828,244 to Sardella, or other similar sheet feeders may be modified and employed to operate in tandem with the machine retrofit described above.

It should be understood that although feed wheels 41, 42, 43, and 44 and transport wheels 24 and 25 have been used in the embodiment shown and described above, endless drive members (not shown) such as belts may be employed as well.

It will therefore be seen that the present invention allows sheets to be fed eliminating feed roll nip crush, thereby eliminating the need to supply sheets from the corrugator to converting machinery with an Edge Crush Test rating that is from 15% to 20% percent greater than the Edge Crush Test value printed on the certificate stamp, in order to compensate for Edge Crush Test converting machinery degradation.

Although specific versions and embodiments of the present invention have been shown and described, it will be understood that the scope of the invention is not limited to the specific embodiments but rather will be indicated in the claims appended.

What is claimed is:

1. A method of retrofitting a corrugated paperboard box converting machine including a main gear train for driving a rotatable major repeat cylinder having a fixed repeat length and rotating at a surface velocity, and also comprising a feed roll nip between an upper feed roll and a lower feed roll for driving a sheet to the repeat cylinder, a variable speed sheet feeder adapted for feeding said sheet to said feed roll nip, and a feed gate, wherein the sheet is crushed by the feed roll nip as the sheet is transported to the repeat cylinder, the steps comprising:

a. removing the variable speed sheet feeder;

b. removing the upper feed roll;

c. removing the lower feed roll;

d. inserting a drive shaft which replaces the lower feed roll for driving the main gear train of the box converting machine;

e. inserting a constant speed vacuum transport section for transporting sheets to the repeat cylinder, said constant speed vacuum transport section adapted to be driven by said drive shaft;

f. inserting a variable speed sheet feeder section adapted to operate with said constant speed vacuum transport section; and g. inserting the feed gate;

wherein the sheet is transported uncrushed by said constant speed vacuum transport section as the sheet is driven to the repeat cylinder.

2. The method of retrofitting a corrugated paperboard box converting machine defined in claim 1 wherein said constant speed vacuum transport section comprises:

a. an enclosure defining a vacuum chamber;

b. a vacuum chamber cover having a plurality of apertures;

c. transport means mounted for rotation in said vacuum chamber and projecting through said apertures for engaging a sheet to drive it to the repeat cylinder;

d. said drive shaft operatively connected for rotating said transport means at said surface velocity of said repeat cylinder; and e. a vacuum blower communicating with said vacuum chamber for generating a vacuum therein.

3. The method of retrofitting a corrugated paperboard box converting machine defined in claim 1 wherein said variable speed sheet feeder section adapted to operate with said constant speed vacuum transport section comprises:

a. an enclosure defining a vacuum chamber;

c. feed means for engaging a sheet to drive it to said constant speed vacuum transport section mounted for rotation in the vacuum chamber;

d. a feed means servo drive motor operatively connected to rotate said feed means at variable speeds;

e. feed interrupt means movable between a lowered feed position and a raised no-feed position;

f. reciprocating means for changing vertical relationship of said feed means and said feed interrupt means so as to alternately provide a lowered feed position wherein said feed means extend above said feed interrupt means and a raised no-feed position wherein said feed interrupt means extends above said feed means;

g. a reciprocating means servo drive motor operatively connected to raise and lower said feed interrupt means;

h. control means operatively connected to said reciprocating means servo drive motor and said feed means servo drive motor for controlling and coordinating velocity, acceleration, deceleration, and dwell of the feed means; and raising, lowering, and dwell of the feed interrupt means.

* * * * *